US007867945B2

(12) United States Patent
Takehara

(10) Patent No.: US 7,867,945 B2
(45) **Date of Patent: *Jan. 11, 2011**

(54) HEAT-SENSITIVE TRANSFER IMAGE-RECEIVING SHEET

(75) Inventor: Hiroshi Takehara, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 823 days.

This patent is subject to a terminal disclaimer.

(21) Appl. No.: 11/711,694

(22) Filed: Feb. 28, 2007

(65) Prior Publication Data

US 2007/0212499 A1 Sep. 13, 2007

(30) Foreign Application Priority Data

Feb. 28, 2006 (JP) ..... 2006-053865
Feb. 28, 2006 (JP) ..... 2006-053954

(51) Int. Cl.
*B41M 5/035* (2006.01)
*B41M 5/42* (2006.01)
*B41M 5/50* (2006.01)

(52) U.S. Cl. ..... 503/227; 428/32.39

(58) Field of Classification Search ..... None
See application file for complete search history.

(56) References Cited

U.S. PATENT DOCUMENTS 5,455,217 A * 10/1995 Chang et al. ..... 503/227
5,604,078 A * 2/1997 Campbell et al. ..... 430/201
7,381,685 B2 * 6/2008 Oguma et al. ..... 503/227
7,485,402 B2 * 2/2009 Arai et al. ..... 430/201

FOREIGN PATENT DOCUMENTS

| | | | |
|---|---|---|---|
| JP | 61-132949 | A | 6/1986 |
| JP | 63-87286 | A | 4/1988 |
| JP | 2-89690 | | 3/1990 |
| JP | 5-246153 | | 9/1993 |
| JP | 5-286261 | A | 11/1993 |
| JP | 7-101170 | A | 4/1995 |
| JP | 9-5930 | A | 1/1997 |
| JP | 11-321128 | | 11/1999 |
| JP | 2002-192842 | A | 7/2002 |
| JP | 2003-237248 | A | 8/2003 |
| JP | 2005-335115 | A | 12/2005 |
| JP | 2006-88691 | A | 4/2006 |
| WO | 98/00257 | A1 | 1/1998 |

* cited by examiner

*Primary Examiner*—Bruce H Hess
(74) *Attorney, Agent, or Firm*—Sughrue Mion, PLLC

(57) ABSTRACT

A heat-sensitive transfer image-receiving sheet having a support, at least one receptor layer containing a polymer latex, and at least one heat insulation layer containing hollow polymer particles which layer is provided between the support and the receptor layer, wherein the support has a base paper and a resin layer other than a polypropylene layer that is provided at least on the side of the base paper to which the receptor layer is provided; and a heat-sensitive transfer image-receiving sheet having a support, at least one receptor layer containing a polymer latex, and at least one heat insulation layer containing hollow polymer particles which layer is provided between the support and the receptor layer, wherein the support has a base paper and a resin layer which is provided without using an adhesive at least on the side of the base paper to which the receptor layer is provided.

24 Claims, No Drawings

HEAT-SENSITIVE TRANSFER IMAGE-RECEIVING SHEET

FIELD OF THE INVENTION

The present invention relates to a heat-sensitive transfer image-receiving sheet. In particular, the present invention relates to a heat-sensitive transfer image-receiving sheet, which is high in transfer density and excellent in image preservability.

Further, the present invention relates to a heat-sensitive transfer image-receiving sheet for delivering excellent images, which are high in transfer density and reduced in image unevenness resulting from contamination of a printer.

BACKGROUND OF THE INVENTION

Various heat transfer recording methods have been known so far. Among these methods, dye diffusion transfer recording systems attract attention as a process that can produce a color hard copy having an image quality closest to that of silver salt photography (see, for example, "Joho Kiroku (Hard Copy) to Sono Zairyo no Shintenkai (Information Recording (Hard Copy) and New Development of Recording Materials)" published by Toray Research Center Inc., 1993, pp. 241-285; and "Printer Zairyo no Kaihatsu (Development of Printer Materials)" published by CMC Publishing Co., Ltd., 1995, p. 180). Moreover, this system has advantages over silver salt photography: it is a dry system, it enables direct visualization from digital data, it makes reproduction simple, and the like.

In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

In an image-receiving sheet on this system, a receptor layer for fixation of dyes transferred to the sheet is formed on a support, and besides, a layer having high cushion properties, such as a foam layer made up of a resin and a foaming agent or a porous layer containing hollow polymer particles, is generally formed between the support and the receptor layer with the intention of enhancing adhesion of the image-receiving sheet to a transfer sheet (see, e.g., JP-A-11-321128 ("JP-A" means unexamined published Japanese patent application) and JP-A-2-89690).

JP-A-11-321128 discloses forming an intermediate layer containing hollow particles and a high molecular weight compound having resistance to organic solvent as main components on a support by coating and drying, and subsequently forming a receptor layer by applying a resin coating solution prepared using an organic solvent. However, this image-receiving sheet has problems of insufficient sensitivity and high costs. In addition thereto, there is a problem that output of a great many sheets of image causes image defects resulting from contamination of a platen roller and a thermal head mounted inside the printer with a white powdery contaminant which is thought to be traceable to image-receiving paper.

Further, JP-A-2-89690 discloses a heat-sensitive transfer image-receiving sheet having a combination of an image-receiving layer (a receptor layer) and a layer in which hollow-spherical pigment particles are dispersed, but it has a problem that the images after image transfer become blurred.

On the other hand, JP-A-5-246153 proposes a structure having a receptor layer provided on a microvoid layer; still, it has problems of insufficient sensitivity and high cost.

SUMMARY OF THE INVENTION

The present resides in a heat-sensitive transfer image-receiving sheet comprising a support, at least one receptor layer containing a polymer latex, and at least one heat insulation layer containing hollow polymer particles which layer is provided between the support and the receptor layer, wherein the support comprises a base paper and a resin layer other than a polypropylene layer that is provided at least on the side of the base paper to which the receptor layer is provided.

Further, the present invention resides in a heat-sensitive transfer image-receiving sheet comprising a support, at least one receptor layer containing a polymer latex, and at least one heat insulation layer containing hollow polymer particles which layer is provided between the support and the receptor layer, wherein the support comprises a base paper and a resin layer which is provided without using an adhesive at least on the side of the base paper to which the receptor layer is provided.

Other and further features and advantages of the invention will appear more fully from the following description.

DETAILED DESCRIPTION OF THE INVENTION

As a result of intensive studies, it has been found that some of the foregoing problems can be solved by disposing a layer of any resin other than polypropylene on the support, in a heat-sensitive transfer image-receiving sheet having, on a support, a heat insulation layer containing hollow polymer particles.

Further, it has been found that some of the foregoing problems can be solved by using no adhesive when providing a resin layer on a support, in the preparation of a heat-sensitive transfer image-receiving sheet having, on the support, a heat insulation layer containing hollow polymer particles.

The present invention provides the following means:

(1) A heat-sensitive transfer image-receiving sheet comprising a support, at least one receptor layer containing a polymer latex, and at least one heat insulation layer containing hollow polymer particles which layer is provided between the support and the receptor layer, wherein the support comprises a base paper (base sheet) and a resin layer other than a polypropylene layer that is provided at least on the side of the base paper to which the receptor layer is provided.

(2) The heat-sensitive transfer image-receiving sheet as described in (1), wherein the resin layer is a biaxially-stretched microvoid film.

(3) The heat-sensitive transfer image-receiving sheet as described in (1) or (2), wherein the heat insulation layer containing hollow polymer particles is free of any resins having poor resistance to an organic solvent except for the hollow polymer particles.

(4) A heat-sensitive transfer image-receiving sheet comprising a support, at least one receptor layer containing a polymer latex, and at least one heat insulation layer containing hollow polymer particles which layer is provided between the support and the receptor layer, wherein the support comprises a base paper and a resin layer which is provided without using an adhesive at least on the side of the base paper to which the receptor layer is provided.

(5) The heat-sensitive transfer image-receiving sheet as described in (4), wherein the resin layer provided on the support is a polyethylene layer.

(6) The heat-sensitive transfer image-receiving sheet as described in (4) or (5), wherein the heat insulation layer containing hollow polymer particles is free of any resins having poor resistance to an organic solvent except for the hollow polymer particles.

Hereinafter, a first embodiment of the present invention means to include the heat-sensitive transfer image-receiving sheets described in the items (1) to (3) above. A second embodiment of the present invention means to include the heat-sensitive transfer image-receiving sheets described in the items (4) to (6) above.

Herein, the present invention means to include all of the above first and second embodiments, unless otherwise specified.

The heat-sensitive transfer image-receiving sheet according to the first embodiment of the present invention gives an image that is high in transfer density and excellent in image preservability.

Further, the heat-sensitive transfer image-receiving sheet according to the second embodiment of the present invention gives an image that is high in transfer density and free from image defects resulting from internal contamination of printers, and can be prepared at low costs.

The present invention will be explained in detail below.

The heat-sensitive transfer image-receiving sheet of the present invention is provided with at least one dye-receiving layer (receptor layer) on a support, and at least one heat insulation layer (porous layer) between the support and the receptor layer. Moreover, an undercoat layer such as a white-background-control layer, a charge-control layer (an electrification-control layer), an adhesive layer, and a primer layer, may be provided between the receptor layer and the heat insulation layer.

The receptor layer and the heat insulation layer are preferably formed by a simultaneous multi-layer coating. When the undercoat layer is provided, the receptor layer, the undercoat layer, and the heat insulation layer may be formed by the simultaneous multi-layer coating.

(Receptor Layer)

The receptor layer performs functions of receiving dyes transferred from an ink sheet and retaining images formed. In the image-receiving sheet according to the present invention, the receptor layer contains a polymer latex. The receptor layer may be a single layer or multi layers. The receptor layer preferably contains a water-soluble polymer as described later.

<Polymer Latex>

The polymer latex for use in the present invention is explained.

In the heat-sensitive transfer image-receiving sheet of the present invention, the polymer latex that can be used in the receptor layer is a dispersion in which a water-insoluble, hydrophobic polymer is dispersed as fine particles in a water-soluble dispersion medium. The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. Polymer latexes are described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki, and Keishi Kasahara, issued by Kobunshi Kanko Kai (1993); Soichi Muroi, "Gosei Latex no Kagaku (Chemistry of Synthetic Latex)", issued by Kobunshi Kanko Kai (1970); Yoshiaki Miyosawa (supervisor), "Suisei Coating-Zairyo no Kaihatsu to Oyo (Development and Application of Aqueous Coating Material)", issued by CMC Publishing Co., Ltd. (2004) and JP-A-64-538, and so forth. The dispersed particles preferably have a mean particle size (diameter) of about 1 to 50,000 nm, more preferably about 5 to 1,000 nm.

The particle size distribution of the dispersed particles is not particularly limited, and the particles may have either wide particle-size distribution or monodispersed particle-size distribution.

The polymer latex for use in the present invention may be latex of the so-called core/shell type, other than ordinary polymer latex of a uniform structure. When using a core/shell type polymer latex, it is preferred in some cases that the core and the shell have different glass transition temperatures. The glass transition temperature (Tg) of the polymer latex for use in the present invention is preferably −30° C. to 100° C., more preferably 0° C. to 80° C., further more preferably 10° C. to 70° C., and especially preferably 15° C. to 60° C.

In the present invention, as preferable types of polymer latex, hydrophobic polymers such as acrylic-series polymers, polyesters, rubbers (e.g., SBR resins), polyurethanes, polyvinyl chlorides, polyvinyl acetates, polyvinylidene chlorides, and polyolefins, are preferably used. These polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number average molecular weight. A polymer having an excessively small molecular weight imparts insufficient dynamic strength to a layer containing a latex of the polymer, and a polymer having an excessively large molecular weight brings about poor filming ability, and therefore both cases are undesirable. Crosslinkable polymer latexes are also preferably used.

No particular limitation is imposed on the monomer to be used in synthesizing the polymer latex that can be used in the present invention, and the following monomer groups (a) to (j) may be preferably used as those polymerizable in a usual radical polymerization or ion polymerization method. These monomers may be selected singly or combined freely to synthesize a polymer latex.

—Monomer Groups (a) to (j)—

(a) Conjugated dienes: 1,3-pentadiene, isoprene, 1-phenyl-1,3-butadiene, 1-α-naphthyl-1,3-butadiene, 1-β-naphthyl-1,3-butadiene, cyclopentadiene, etc.

(b) Olefins: ethylene, propylene, vinyl chloride, vinylidene chloride, 6-hydroxy-1-hexene, 4-pentenoic acid, methyl 8-nonenate, vinylsulfonic acid, trimethylvinylsilane, trimethoxyvinylsilane, 1,4-divinylcyclohexane, 1,2,5-trivinylcyclohexane, etc.

(c) α, β-unsaturated carboxylates: alkyl acrylates, such as methyl acrylate, ethyl acrylate, butyl acrylate, cyclohexyl acrylate, 2-ethylhexyl acrylate, and dodecyl acrylate; substituted alkyl acrylates, such as 2-chloroethyl acrylate, benzyl acrylate, and 2-cyanoethyl acrylate; alkyl methacrylates, such as methyl methacrylate, butyl methacrylate, 2-ethyl-hexyl methacrylate, and dodecyl methacrylate; substituted alkyl methacrylates, such as 2-hydroxyethyl methacrylate, glycidyl methacrylate, glycerin monomethacrylate, 2-acetoxyethyl methacrylate, tetrahydrofurfuryl methacrylate, 2-methoxyethyl methacrylate, polypropylene glycol monomethacrylates (mole number of added polyoxypropylene=2 to 100), 3-N,N-dimethylaminopropyl methacrylate, chloro-3-N,N,N-trimethylammoniopropyl methacrylate, 2-carboxyethyl methacrylate, 3-sulfopropyl methacrylate, 4-oxysulfobutyl methacrylate, 3-trimethoxysilylpropyl methacrylate, allyl methacrylate, and 2-isocyanatoethyl methacrylate; derivatives of unsaturated dicarboxylic acids, such as monobutyl maleate, dimethyl maleate, monomethyl itaconate, and dibutyl itaconate; multifunctional esters, such as ethylene glycol diacrylate, ethylene glycol dimethacrylate, 1,4-cyclohexane diacrylate, pentaerythritol tetramethacrylate, pentaerythritol triacrylate, trimethylolpropane triacrylate, trimethylolethane triacrylate, dipentaerythritol pentamethacrylate, pentaerythritol hexaacrylate, and 1,2,4-cyclohexane tetramethacrylate; etc.

(d) β-unsaturated carboxylic amides: acrylamide, methacrylamide, N-methylacrylamide, N,N-dimethylacrylamide, N-methyl-N-hydroxyethylmethacrylamide, N-tert-butylacrylamide, N-tert-octylmethacrylamide, N-cyclohexylacrylamide, N-phenylacrylamide, N-(2-acetoacetoxyethyl) acrylamide, N-acryloylmorpholine, diacetone acrylamide, itaconic diamide, N-methylmaleimide, 2-acrylamide-methylpropane sulfonic acid, methylenebisacrylamide, dimethacryloylpiperazine, etc.

(e) Unsaturated nitriles: acrylonitrile, methacrylonitrile, etc.

(f) Styrene and derivatives thereof: styrene, vinyltoluene, p-tert-butylstyrene, vinylbenzoic acid, methyl vinylbenzoate, α-methylstyrene, p-chloromethylstyrene, vinyinaphthalene, p-hydroxymethylstyrene, sodium p-styrenesulfonate, potassium p-styrenesulfinate, p-aminomethylstyrene, 1,4-divinylbenzene, etc.

(g) Vinyl ethers: methyl vinyl ether, butyl vinyl ether, methoxyethyl vinyl ether, etc.

(h) Vinyl esters: vinyl acetate, vinyl propionate, vinyl benzoate, vinyl salicylate, vinyl chloroacetate, etc.

(i) α,β-unsaturated carboxylic acids and salts thereof: acrylic acid, methacrylic acid, itaconic acid, maleic acid, sodium acrylate, ammonium methacrylate, potassium itaconate, etc.

(j) Other polymerizable monomers: N-vinylimidazole, 4-vinylpyridine, N-vinylpyrrolidone, 2-vinyloxazoline, 2-isopropenyloxazoline, divinylsulfone, etc.

Polymer latexes that can be used in the present invention are also commercially available, and polymers described below may be utilized.

Examples of the acrylic-series polymers include Cevian A-4635, 4718, and 4601 (trade names, manufactured by Daicel Chemical Industries); Nipol Lx811, 814, 821, 820, 855 (P-17: Tg 36° C.), and 857x2 (P-18: Tg 43° C.) (trade names, manufactured by Nippon Zeon Co., Ltd.); Voncoat R3370 (P-19: Tg 25° C.), and 4280 (P-20: Tg 15° C.) (trade names, manufactured by Dai-Nippon Ink & Chemicals, Inc.); Julimer ET-410 (P-21: Tg 44° C.) (trade name, manufactured by Nihon Junyaku K. K.); AE 116 (P-22: Tg 50° C.), AE119 (P-23: Tg 55° C.), AE121 (P-24: Tg 58° C.), AE125 (P-25: Tg 60° C.), AE134 (P-26: Tg 48° C.), AE137 (P-27: Tg 48° C.), AE140 (P-28: Tg 53° C.), and AE173 (P-29: Tg 60° C.) (trade names, manufactured by JSR Corporation); Aron A-104 (P-30: Tg 45° C.) (trade name, manufactured by Toagosei Co., Ltd.); NS-600X, and NS-620X (trade names, manufactured by Takamatsu Yushi K. K.); VINYBLAN 2580, 2583, 2641, 2770, 2770H, 2635, 2886, 5202C, and 2706 (trade names, manufactured by Nissin Chemical Industry Co., Ltd.).

Examples of the polyesters include FINETEX ES650, 611, 675, and 850 (trade names, manufactured by Dainippon Ink and Chemicals, Incorporated); WD-size, and WMS (trade names, manufactured by Eastman Chemical Ltd.); A-110, A-115GE, A-120, A-121, A-124GP, A-124S, A-160, A-210, A-215GE, A-510, A-513E, A-515GE, A-520, A-610, A-613, A-615GE, A-620, WAC-15, WAC-17XC, WAC-20, S-110, S-110EA, S-111SL, S-120, S-140, S-140A, S-250, S-252G, S-250S, S-320, S-680, DNS-63P, NS-122L, NS-122LX, NS-244LX, NS-140L, NS-141LX, and NS-282LX (trade names, manufactured by Takamatsu Yushi K. K.); Aronmelt PES-1000 series, and PES-2000 series (trade names, manufactured by Toagosei Co., Ltd.); Bironal MD-1100, MD-1200, MD-1220, MD-1245, MD-1250, MD-1335, MD-1400, MD-1480, MD-1500, MD-1930, and MD-1985 (trade names, manufactured by Toyobo Co., Ltd.); and Ceporjon ES (trade name, manufactured by Sumitomo Seika Chemicals Co., Ltd.).

Examples of the polyurethanes include HYDRAN AP10, AP20, AP30, AP40, and 101H, Vondic 1320NS and 1610NS (trade names, manufactured by Dainippon Ink and Chemicals, Incorporated); D-1000, D-2000, D-6000, D-4000, and D-9000 (trade names, manufactured by Dainichi Seika Color & Chemicals Mfg. Co., Ltd.); NS-155X, NS-310A, NS-310X, and NS-311X (trade names, manufactured by Takamatsu Yushi K. K.); Elastron (trade name, manufactured by Dai-ichi Kogyo Seiyaku Co., Ltd.).

Examples of the rubbers include LACSTAR 7310K, 3307B, 4700H, and 7132C (trade names, manufactured by Dainippon Ink & Chemicals Incorporated); Nipol Lx416, LX410, LX430, LX435, LX110, LX415A, LX438C, 2507H, LX303A, LX407BP series, V1004, and MH5055 (trade names, manufactured by Nippon Zeon Co., Ltd.).

Examples of the polyvinyl chlorides include G351, and G576 (trade names, manufactured by Nippon Zeon Co., Ltd.); VINYBLAN 240, 270, 277, 375, 386, 609, 550, 601, 602, 630, 660, 671, 683, 680, 680S, 681N, 685R, 277, 380, 381, 410, 430, 432, 860, 863, 865, 867, 900, 900GT, 938, and 950 (trade names, manufactured by Nissin Chemical Industry Co., Ltd.).

Examples of polyvinylidene chlorides include L502 and L513 (trade names, manufactured by Asahi Kasei Corporation); D-5071 (trade name, manufactured by Dai-Nippon Ink & Chemicals, Inc.).

Examples of polyolefins include Chemipearl S120, SA100, and V300 (P-40: Tg 80° C.) (trade names, manufactured by Mitsui Petrochemical); Voncoat 2830, 2210, and 2960 (trade names, manufactured by Dainippon Ink and Chemicals, Incorporated); Zaikusen and Ceporjon G (trade names, manufactured by Sumitomo Seika Chemicals Co., Ltd.).

Examples of copolymer nylons include Ceporjon PA (trade name, manufactured by Sumitomo Seika Chemicals Co., Ltd.).

Examples of the polyvinyl acetates include VINYBLAN 1080, 1082, 1085W, 1108W, 1108S, 1563M, 1566, 1570, 1588C, A22J7-F2, 1128C, 1137, 1138, A20J2, A23J1, A23J1, A23K1, A23P2E, A68J1N, 1086A, 1086, 1086D, 1108S, 1187, 1241LT, 1580N, 1083, 1571, 1572, 1581, 4465, 4466, 4468W, 4468S, 4470, 4485LL, 4495LL, 1023, 1042, 1060, 1060S, 1080M, 1084W, 1084S, 1096, 1570K, 1050, 1050S, 3290, 1017AD, 1002, 1006, 1008, 1107L, 1225, 1245L, GV-6170, GV-6181, 4468W, and 4468S (trade names, manufactured by Nisshin Chemical Industry Co., Ltd.).

These polymer latexes may be used singly, or two or more of these polymers may be blended, if necessary.

In the present invention, it is preferable to prepare the receptor layer by applying an aqueous type coating solution and then drying it. The "aqueous type" so-called here means that 60% by mass or more of the solvent (dispersion medium) of the coating solution is water. As a component other than water in the coating solution, a water miscible organic solvent may be used, such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

The polymer latex for use in the present invention preferably has a minimum film-forming temperature (MFT) of from −30 to 90° C., more preferably from 0 to 70° C. In order to control the minimum film-forming temperature, a film-forming aid may be added. The film-forming aid is also called a temporary plasticizer, and it is an organic compound (usually an organic solvent) that reduces the minimum film-forming temperature of a polymer latex. It is described in, for example, Souichi Muroi, "Gosei Latex no Kagaku (Chemistry of Synthetic Latex)", issued by Kobunshi Kanko Kai (1970). Preferable examples of the film-forming aid are listed below, but the compounds that can be used in the present invention are not limited to the following specific examples.

Z-1: Benzyl alcohol

Z-2: 2,2,4-Trimethylpentanediol-1,3-monoisobutyrate

Z-3: 2-Dimethylaminoethanol

Z-4: Diethylene glycol

Preferable examples of the polymer latex that can be used in the present invention may include polylactates, polyurethanes, polycarbonates, polyesters, polyacetals, SBRs, and polyvinyl chlorides. Among these compounds, most preferred are polyesters, polycarbonates, and polyvinyl chlorides. Among the above examples, the polymer latex for use in the present invention is preferably polyvinyl chlorides, more preferably a copolymer of vinyl chloride and an acrylic ester, further preferably one having a glass transition temperature (Tg) of 30 to 80° C.

In combination with the above-described polymer latex for use in the present invention, any polymer can be used. The polymer that can be used in combination is preferably transparent or translucent, and colorless. The polymer may be a natural resin, polymer, or copolymer; a synthetic resin, polymer, or copolymer; or another film-forming medium; and specific examples include gelatins, polyvinyl alcohols, hydroxyethylcelluloses, cellulose acetates, cellulose acetate butyrates, polyvinylpyrrolidones, caseins, starches, polyacrylic acids, polymethylmethacrylic acids, polyvinyl chlorides, polymethacrylic acids, styrene-maleic anhydride copolymers, styrene-acrylonitrile copolymers, styrene-butadiene copolymers, polyvinyl acetals (e.g. polyvinyl formals, polyvinyl butyrals, etc.), polyesters, polyurethanes, phenoxy resins, polyvinylidene chlorides, polyepoxides, polycarbonates, polyvinyl acetates, polyolefins, and polyamides. In the coating liquid, a binder may be dissolved or dispersed in an aqueous solvent or in an organic solvent, or may be in the form of an emulsion.

The glass transition temperature (Tg) of the binder for use in the invention is preferably in the range of −30° C. to 70° C., more preferably −10° C. to 50° C., still more preferably 0° C. to 40° C., in view of film-forming properties (brittleness for working) and image preservability. A blend of two or more types of polymers can be used as the binder. When a blend of two or more polymers is used, the average Tg obtained by summing up the Tg of each polymer weighted by its proportion, is preferably within the foregoing range. Also, when phase separation occurs or when a core-shell structure is adopted, the weighted average Tg is preferably within the foregoing range.

The glass transition temperature (Tg) is calculated according to the following equation:

$$1/Tg=\Sigma(Xi/Tgi)$$

wherein, assuming that the polymer is a copolymer composed of n monomers from i=1 to i=n, Xi is a weight fraction of the i-th monomer ($\Sigma Xi=1$) and Tgi is glass transition temperature (measured in absolute temperature) of a homopolymer formed from the i-th monomer. The symbol Σ means the sum of i=1 to i=n. The value of the glass transition temperature of a homopolymer formed from each monomer (Tgi) is adopted from J. Brandrup and E. H. Immergut, "Polymer Handbook, 3rd. Edition", Wiley-Interscience (1989).

The polymer used for the binder for use in the present invention can be easily obtained by a solution polymerization method, a suspension polymerization method, an emulsion polymerization method, a dispersion polymerization method, an anionic polymerization method, a cationic polymerization method, or the like. Above all, an emulsion polymerization method in which the polymer is obtained as a latex is the most preferable. Also, a method is preferable in which the polymer is prepared in a solution, and the solution is neutralized, or an emulsifier is added to the solution, to which water is then added, to prepare an aqueous dispersion by forced stirring. For example, an emulsion polymerization method comprises conducting polymerization under stirring at about 30° C. to about 100° C. (preferably 60° C. to 90° C.) for 3 to 24 hours by using water or a mixed solvent of water and a water-miscible organic solvent (such as methanol, ethanol, or acetone) as a dispersion medium, a monomer mixture in an amount of 5 mass % to 150 mass % based on the amount of the dispersion medium, an emulsifier and a polymerization initiator. Various conditions such as the dispersion medium, the monomer concentration, the amount of initiator, the amount of emulsifier, the amount of dispersant, the reaction temperature, and the method for adding monomers are suitably determined considering the type of the monomers to be used. Furthermore, it is preferable to use a dispersant when necessary.

Generally, the emulsion polymerization method can be conducted according to the disclosures of the following documents: "Gosei Jushi Emarujon (Synthetic Resin Emulsions)" (edited by Taira Okuda and Hiroshi Inagaki and published by Kobunshi Kankokai (1978)); "Gosei Ratekkusu no Oyo (Applications of Synthetic Latexes)" (edited by Takaaki Sugimura, Yasuo Kataoka, Soichi Suzuki, and Keiji Kasahara and published by Kobunshi Kankokai (1993)); and "Gosei Ratekkusu no Kagaku (Chemistry of Synthetic Latexes)" (edited by Soichi Muroi and published by Kobunshi Kankokai (1970)). The emulsion polymerization method for synthesizing the polymer latex for use in the present invention may be a batch polymerization method, a monomer (continuous or divided) addition method, an emulsion addition method, or a seed polymerization method. The emulsion polymerization method is preferably a batch polymerization method, a monomer (continuous or divided) addition method, or an emulsion addition method in view of the productivity of latex.

The polymerization initiator may be any polymerization initiator having radical generating ability. The polymerization initiator to be used may be selected from inorganic peroxides such as persulfates and hydrogen peroxide, peroxides described in the organic peroxide catalogue of NOF Corporation, and azo compounds as described in the azo polymerization initiator catalogue of Wako Pure Chemical Industries, Ltd. Among them, water-soluble peroxides such as persulfates and water-soluble azo compounds as described in the azo polymerization initiator catalogue of Wako Pure Chemical Industries, Ltd. are preferable; ammonium persulfate, sodium persulfate, potassium persulfate, azobis(2-methylpropionamidine)hydrochloride, azobis(2-methyl-N-(2-hydroxyethyl)propionamide), and azobiscyanovaleric acid are more preferable; and peroxides such as ammonium persulfate, sodium persulfate, and potassium persulfate are especially preferable from the viewpoints of image preservability, solubility, and cost.

The amount of the polymerization initiator to be added is, based on the total amount of monomers, preferably 0.3 mass % to 2.0 mass %, more preferably 0.4 mass % to 1.75 mass %, and especially preferably 0.5 mass % to 1.5 mass %.

The polymerization emulsifier to be used may be selected from anionic surfactants, nonionic surfactants, cationic surfactants, and ampholytic surfactants. Among them, anionic surfactants are preferable from the viewpoints of dispersibility and image preservability. Sulfonic acid type anionic surfactants are more preferable because polymerization stability can be ensured even with a small addition amount and they have resistance to hydrolysis. Long chain alkyldiphenyl ether disulfonic acid salts (whose typical example is PELEX SS-H (trade name) manufactured by Kao Corporation) are still more preferable, and low electrolyte types such as PIONIN A-43-S (trade name, manufactured by Takemoto Oil & Fat Co., Ltd.) are especially preferable.

The amount of sulfonic acid type anionic surfactant as the polymerization emulsifier is preferably 0.1 mass % to 10.0 mass %, more preferably 0.2 mass % to 7.5 mass %, and especially preferably 0.3 mass % to 5.0 mass %, based on the total amount of monomers.

It is preferable to use a chelating agent in synthesizing the polymer latex to be used in the present invention. The chelating agent is a compound capable of coordinating (chelating) a polyvalent ion such as metal ion (e.g., iron ion) or alkaline earth metal ion (e.g., calcium ion), and examples of the chelate compound which can be used include the compounds described in JP-B-6-8956 ("JP-B" means examined Japanese patent publication), U.S. Pat. No. 5,053,322, JP-A-4-73645, JP-A-4-127145, JP-A-4-247073, JP-A-4-305572, JP-A-6-11805, JP-A-5-173312, JP-A-5-66527, JP-A-5-158195, JP-A-6-118580, JP-A-6-110168, JP-A-6-161054, JP-A-6-175299, JP-A-6-214352, JP-A-7-114161, JP-A-7-11415, JP-A-7-120894, JP-A-7-199433, JP-A-7-306504, JP-A-9-43792, JP-A-8-314090, JP-A-10-182571, JP-A-10-182570, and JP-A-11-190892.

Preferred examples of the chelating agent include inorganic chelate compounds (e.g., sodium tripolyphosphate, sodium hexametaphosphate, sodium tetrapolyphosphate), aminopolycarboxylic acid-based chelate compounds (e.g., nitrilotriacetate, ethylenediaminetetraacetate), organic phosphonic acid-based chelate compounds (e.g., compounds described in Research Disclosure, No. 18170, JP-A-52-102726, JP-A-53-42730, JP-A-56-97347, JP-A-54-121127, JP-A-55-4024, JP-A-55-4025, JP-A-55-29883, JP-A-55-126241, JP-A-55-65955, JP-A-55-65956, JP-A-57-179843, JP-A-54-61125, and West German Patent No. 1045373), polyphenol-based chelating agents, and polyamine-based chelate compounds, with aminopolycarboxylic acid derivatives being particularly preferred.

Preferred examples of the aminopolycarboxylic acid derivative include the compounds shown in the Table attached to "EDTA (—Complexane no Kagaku—) (EDTA—Chemistry of Complexane—)", Nankodo (1977). In these compounds, a part of the carboxyl groups may be substituted by an alkali metal salt such as sodium or potassium or by an ammonium salt. More preferred examples of the aminopolycarboxylic acid derivative include iminodiacetic acid, N-methyliminodiacetic acid, N-(2-aminoethyl)iminodiacetic acid, N-(carbamoylmethyl)imino diacetic acid, nitrilotriacetic acid, ethylenediamine-N,N'-diacetic acid, ethylenediamine-N,N'-di-α-propionic acid, ethylenediamine-N,N'-di-β-propionic acid, N,N'-ethylene-bis(α-o-hydroxyphenyl)glycine, N,N'-di(2-hydroxybenzyl)ethylenediamine-N,N'-diacetic acid, ethylenediamine-N,N'-diacetic acid-N,N'-diacetohydroxamic acid, N-hydroxyethylethylenediamine-N,N',N'-triacetic acid, ethylenediamine-N,N,N',N'-tetraacetic acid, 1,2-propylenediamine-N,N,N',N'-tetraacetic acid, d,1-2,3-diaminobutane-N,N,N',N'-tetraacetic acid, meso-2,3-diaminobutane-N,N,N',N'-tetraacetic acid, 1-phenylethylenediamine-N,N,N',N'-tetraacetic acid, d,1-1,2-diphenylethylenediamine-N,N,N',N'-tetraacetic acid, 1,4-diaminobutane-N,N,N',N'-tetraacetic acid, trans-cyclobutane-1,2-diamine-N,N,N',N'-tetraacetic acid, trans-cyclopentane-1,2-diamine-N,N,N',N'-tetraacetic acid, trans-cyclohexane-1,2-diamine-N,N,N',N'-tetraacetic acid, cis-cyclohexane-1,2-diamine-N,N,N',N'-tetraacetic acid, cyclohexane-1,3-diamine-N,N,N',N'-tetraacetic acid, cyclohexane-1,4-diamine-N,N,N',N'-tetraacetic acid, o-phenylenediamine-N,N,N',N'-tetraacetic acid, cis-1,4-diaminobutene-N,N,N',N'-tetraacetic acid, trans-1,4-diaminobutene-N,N,N',N'-tetraacetic acid, α,α'-diamino-o-xylene-N,N,N',N'-tetraacetic acid, 2-hydroxy-1,3-propanediamine-N,N,N',N'-tetraacetic acid, 2,2'-oxy-bis(ethyliminodiacetic acid), 2,2'-ethylenedioxy-bis(ethyliminodiacetic acid), ethylenediamine-N,N'-diacetic acid-N,N'-di-α-propionic acid, ethylenediamine-N,N'-diacetic acid-N,N'-di-β-propionic acid, ethylenediamine-N,N,N',N'-tetrapropionic acid, diethylenetriamine-N,N,N',N",N"-pentaacetic acid, triethylenetetramine-N,N,N',N",N'",N'"-hexaacetic acid, and 1,2,3-triaminopropane-N,N,N',N",N'",N'"-hexaacetic acid. In these compounds, a part of the carboxyl groups may be substituted by an alkali metal salt such as sodium or potassium or by an ammonium salt.

The amount of the chelating agent to be added is preferably 0.01 mass % to 0.4 mass %, more preferably 0.02 mass % to 0.3 mass %, and especially preferably 0.03 mass % to 0.15 mass %, based on the total amount of monomers. When the addition amount of the chelating agent is too small, metal ions entering during the preparation of the polymer latex are not sufficiently trapped, and the stability of the latex against aggregation is lowered, whereby the coating properties become worse. When the amount is too large, the viscosity of the latex increases, whereby the coating properties are lowered.

In the preparation of the polymer latex to be used in the present invention, it is preferable to use a chain transfer agent. As the chain transfer agent, ones described in Polymer Handbook (3rd Edition) (Wiley-Interscience, 1989) are preferable. Sulfur compounds are more preferable because they have high chain-transfer ability and because the required amount is small. Especially, hydrophobic mercaptane-based chain transfer agents such as tert-dodecylmercaptane and n-dodecylmercaptane are preferable.

The amount of the chain transfer agent to be added is preferably 0.2 mass % to 2.0 mass %, more preferably 0.3 mass % to 1.8 mass %, and especially preferably 0.4 mass % to 1.6 mass %, based on the total amount of monomers.

Besides the foregoing compounds, in the emulsion polymerization, use can be made of additives, such as electrolytes, stabilizers, thickeners, defoaming agents, antioxidants, vulcanizers, antifreezing agents, gelling agents, and vulcanization accelerators, as described, for example, in Synthetic Rubber Handbook.

In the coating solution of the polymer latex to be used in the present invention, an aqueous solvent can be used as the solvent, and a water-miscible organic solvent may optionally be used in combination. Examples of the water-miscible organic solvent include alcohols (for example, methyl alcohol, ethyl alcohol, and propyl alcohol), cellosolves (for example, methyl cellosolve, ethyl cellosolve, and butyl cellosolve), ethyl acetate, and dimethylformamide. The amount of the organic solvent to be added is preferably 50 mass % or less of the entire solvent, more preferably 30 mass % or less of the entire solvent.

Furthermore, in the polymer latex to be used in the present invention, the polymer concentration is, based on the amount of the latex liquid, preferably 10 mass % to 70 mass %, more preferably 20 mass % to 60 mass %, and especially preferably 30 mass % to 55 mass %.

The polymer latex in the image-receiving sheet that can be used in the present invention includes a state of a gel or dried film formed by removing a part of solvents by drying after coating.

<Water-Soluble Polymer>

The receptor layer preferably contains a water-soluble polymer. Herein, the "water-soluble polymer" means a polymer which dissolves, in 100 g water at 20° C., in an amount of preferably 0.05 g or more, more preferably 0.1 g or more, further preferably 0.5 g or more, and particularly preferably 1 g or more. The water-soluble polymer which can be used in the present invention is natural polymers (polysaccharide type, microorganism type, and animal type), semi-synthetic polymers (cellulose-based, starch-based, and alginic acid-based), and synthetic polymer type (vinyl type and others); and synthetic polymers including polyvinyl alcohols, and natural or semi-synthetic polymers using celluloses derived from plant as starting materials, which will be explained later, correspond to the water-soluble polymer usable in the present invention. The polymer latexes recited above are not included in the water-soluble polymers which can be used in the present invention.

Among the water-soluble polymers which can be used in the present invention, the natural polymers and the semi-synthetic polymers will be explained in detail. Specific examples include the following polymers: plant type polysaccharides such as gum arabics, κ-carrageenans, t-carrageenans, λ-carrageenans, guar gums (e.g. Supercol, manufactured by Squalon), locust bean gums, pectins, tragacanths, corn starches (e.g. Purity-21, manufactured by National Starch & Chemical Co.), and phosphorylated starches (e.g. National 78-1898, manufactured by National Starch & Chemical Co.); microbial type polysaccharides such as xanthan gums (e.g. Keltrol T, manufactured by Kelco) and dextrins (e.g. Nadex 360, manufactured by National Starch & Chemical Co.); animal type natural polymers such as gelatins (e.g. Crodyne B419, manufactured by Croda), caseins, sodium chondroitin sulfates (e.g. Cromoist CS, manufactured by Croda); cellulose-based polymers such as ethylcelluloses (e.g. Cellofas WLD, manufactured by I.C.I.), carboxymethylcelluloses (e.g. CMC, manufactured by Daicel), hydroxyethylcelluloses (e.g. HEC, manufactured by Daicel), hydroxypropylcelluloses (e.g. Klucel, manufactured by Aqualon), methylcelluloses (e.g. Viscontran, manufactured by Henkel), nitrocelluloses (e.g. Isopropyl Wet, manufactured by Hercules), and cationated celluloses (e.g. Crodacel QM, manufactured by Croda); starches such as phosphorylated starches (e.g. National 78-1898, manufactured by National Starch & Chemical Co.); alginic acid-based compounds such as sodium alginates (e.g. Keltone, manufactured by Kelco) and propylene glycol alginates; and other polymers such as cationated guar gums (e.g. Hi-care 1000, manufactured by Alcolac) and sodium hyaluronates (e.g. Hyalure, manufactured by Lifecare Biomedial) (all of the names are trade names).

Among the water-soluble polymers which can be used in the present invention, the synthetic polymers will be explained in detail. Examples of the acryl type include sodium polyacrylates, polyacrylic acid copolymers, polyacrylamides, polyacrylamide copolymers, and polydiethylaminoethyl(meth)acrylate quaternary salts or their copolymers. Examples of the vinyl type include polyvinylpyrrolidones, polyvinylpyrrolidone copolymers, and polyvinyl alcohols. Examples of the others include polyethylene glycols, polypropylene glycols, polyisopropylacrylamides, polymethyl vinyl ethers, polyethyleneimines, polystyrenesulfonic acids or their copolymers, naphthalenesulfonic acid condensate salts, polyvinylsulfonic acids or their copolymers, polyacrylic acids or their copolymers, acrylic acid or its copolymers, maleic acid copolymers, maleic acid monoester copolymers, acryloylmethylpropanesulfonic acid or its copolymers, polydimethyldiallylammonium chlorides or their copolymers, polyamidines or their copolymers, polyimidazolines, dicyanamide type condensates, epichlorohydrin/dimethylamine condensates, Hofmann decomposed products of polyacrylamides, and water-soluble polyesters (Plascoat Z-221, Z-446, Z-561, Z-450, Z-565, Z-850, Z-3308, RZ-105, RZ-570, Z-730 and RZ-142 (all of these names are trade names), manufactured by Goo Chemical Co., Ltd.).

In addition, highly-water-absorptive polymers, namely, homopolymers of vinyl monomers having —COOM or —$SO_3M$ (M represents a hydrogen atom or an alkali metal) or copolymers of these vinyl monomers among them or with other vinyl monomers (for example, sodium methacrylate, ammonium methacrylate, Sumikagel L-5H (trade name) manufactured by Sumitomo Chemical Co., Ltd.) as described in, for example, U.S. Pat. No. 4,960,681 and JP-A-62-245260, may also be used.

Among the water-soluble synthetic polymers that can be used in the present invention, the polyvinyl alcohols are explained in detail below.

Examples of completely saponificated polyvinyl alcohol include PVA-105 [polyvinyl alcohol (PVA) content: 94.0 mass % or more; degree of saponification: 98.5±0.5 mol %; content of sodium acetate: 1.5 mass % or less; volatile constituent: 5.0 mass % or less; viscosity (4 mass %; 20° C.): 5.6±0.4 CPS]; PVA-110 [PVA content: 94.0 mass %; degree of saponification: 98.5±0.5 mol %; content of sodium acetate: 1.5 mass %; volatile constituent: 5.0 mass %; viscosity (4 mass %; 20° C.): 11.0±0.8 CPS]; PVA-117 [PVA content: 94.0 mass %; degree of saponification: 98.5±0.5 mol %; content of sodium acetate: 1.0 mass %; volatile constituent: 5.0 mass %; viscosity (4 mass %; 20° C.): 28.0±3.0 CPS]; PVA-117H [PVA content 93.5 mass %; degree of saponification: 99.6±0.3 mol %; content of sodium acetate: 1.85 mass %; volatile constituent: 5.0 mass %; viscosity (4 mass %; 20° C.): 29.0±3.0 CPS]; PVA-120 [PVA content: 94.0 mass %; degree of saponification: 98.5±0.5 mol %; content of sodium acetate: 1.0 mass %; volatile constituent: 5.0 mass %; viscosity (4 mass %; 20° C.): 39.5±4.5 CPS]; PVA-124 [PVA content: 94.0 mass %; degree of saponification: 98.5±0.5 mol %; content of sodium acetate: 1.0 mass %; volatile constituent: 5.0 mass %; viscosity (4 mass %; 20° C.): 60.0±6.0 CPS];

PVA-124H [PVA content: 93.5 mass %; degree of saponification: 99.6±0.3 mol %; content of sodium acetate: 1.85 mass %; volatile constituent: 5.0 mass %; viscosity (4 mass %; 20° C.): 61.0±6.0 CPS]; PVA-CS [PVA content: 94.0 mass %; degree of saponification: 97.5±0.5 mol %; content of sodium acetate: 1.0 mass %; volatile constituent: 5.0 mass %; viscosity (4 mass %; 20° C.): 27.5±3.0 CPS]; PVA-CST [PVA content: 94.0 mass %; degree of saponification: 96.0±0.5 mol %; content of sodium acetate: 1.0 mass %; volatile constituent: 5.0 mass %; viscosity (4 mass %; 20° C.): 27.0±3.0 CPS]; and PVA-HC [PVA content: 90.0 mass %; degree of saponification: 99.85 mol % or more; content of sodium acetate: 2.5 mass %; volatile constituent: 8.5 mass %; viscosity (4 mass %; 20° C.): 25.0±3.5 CPS] (all trade names, manufactured by Kuraray Co., Ltd.), and the like.

Examples of partially saponificated polyvinyl alcohol include PVA-203 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.4±0.2 CPS]; PVA-204 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.9±0.3 CPS]; PVA-205 [PVA content: 94.0 mass %; degree of saponification: 88.0±1.5 mol %; content of sodium acetate: 1.0 mass %; volatile constituent: 5.0 mass %; viscosity (4 mass %; 20° C.): 5.0±0.4 CPS]; PVA-210 [PVA content: 94.0 mass %; degree of saponification: 88.0±1.0 mol %; content of sodium acetate: 1.0 mass %; volatile constituent: 5.0 mass %; viscosity (4 mass %; 20° C.): 9.0±1.0 CPS]; PVA-217 [PVA content: 94.0 mass %; degree of saponification: 88.0±1.0 mol %; content of sodium acetate: 1.0 mass %; volatile constituent: 5.0 mass %; viscosity (4 mass %; 20° C.): 22.5±2.0 CPS]; PVA-220 [PVA content: 94.0 mass %; degree of saponification: 88.0±1.0 mol %; content of sodium acetate: 1.0 mass %; volatile constituent: 5.0 mass %; viscosity (4 mass %; 20° C.): 30.0±3.0 CPS]; PVA-224 [PVA content: 94.0 mass %; degree of saponification: 88.0±1.5 mol %; content of sodium acetate: 1.0 mass %; volatile constituent: 5.0 mass %; viscosity (4 mass %; 20° C.): 44.0±4.0 CPS]; PVA-228 [PVA content: 94.0 mass %; degree of saponification: 88.0±1.5 mol %; content of sodium acetate: 1.0 mass %; volatile constituent: 5.0 mass %; viscosity (4 mass %; 20° C.): 65.0±5.0 CPS]; PVA-235 [PVA content: 94.0 mass %; degree of saponification: 88.0±1.5 mol %; content of sodium acetate: 1.0 mass %; volatile constituent: 5.0 mass %; viscosity (4 mass %; 20° C.): 95.0±15.0 CPS]; PVA-217EE [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-217E [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-220E [PVA content: 94.0 mass %; degree of saponification: 88.0±1.0 mol %; content of sodium acetate: 1.0 mass %; volatile constituent: 5.0 mass %; viscosity (4 mass %; 20° C.): 31.0±4.0 CPS]; PVA-224E [PVA content: 94.0 mass %; degree of saponification: 88.0±1.0 mol %; content of sodium acetate: 1.0 mass %; volatile constituent: 5.0 mass %; viscosity (4 mass %; 20° C.): 45.0±5.0 CPS]; PVA-403 [PVA content: 94.0 mass %; degree of saponification: 80.0±1.5 mol %; content of sodium acetate: 1.0 mass %; volatile constituent: 5.0 mass %; viscosity (4 mass %; 20° C.): 3.1±0.3 CPS]; PVA-405 [PVA content: 94.0 mass %; degree of saponification: 81.5±1.5 mol %; content of sodium acetate: 1.0 mass %; volatile constituent: 5.0 mass %; viscosity (4 mass %; 20° C.): 4.8±0.4 CPS]; PVA-420 [PVA content: 94.0 mass %; degree of saponification: 79.5±1.5 mol %; content of sodium acetate: 1.0 mass %; volatile constituent: 5.0 mass %]; PVA-613 [PVA content: 94.0 mass %; degree of saponification: 93.5±1.0 mol %; content of sodium acetate: 1.0 mass %; volatile constituent: 5.0 mass %; viscosity (4 mass %; 20° C.): 16.5±2.0 CPS]; L-8 [PVA content: 96.0 mass %; degree of saponification: 71.0±1.5 mol %; content of sodium acetate: 1.0 mass % (ash); volatile constituent: 3.0 mass %; viscosity (4 mass %; 20° C.): 5.4±0.4 CPS] (all trade names, manufactured by Kuraray Co., Ltd.), and the like.

The above values were measured in the manner described in JIS K-6726-1977.

With respect to modified polyvinyl alcohols, those described in Koichi Nagano, et al., "Poval", Kobunshi Kankokai, Inc. are useful. The modified polyvinyl alcohols include polyvinyl alcohols modified by cations, anions, —SH compounds, alkylthio compounds, or silanols.

Examples of such modified polyvinyl alcohols (modified PVA) include C polymers such as C-118, C-318, C-318-2A, and C-506 (all being trade names of Kuraray Co., Ltd.); HL polymers such as HL-12E and HL-1203 (all being trade names of Kuraray Co., Ltd.); HM polymers such as HM-03 and HM-N-03 (all being trade names of Kuraray Co., Ltd.); K polymers such as KL-118, KL-318, KL-506, KM-118T, and KM-618 (all being trade names of Kuraray Co., Ltd.); M polymers such as M-115 (a trade name of Kuraray co., Ltd.); MP polymers such as MP-102, MP-202, and MP-203 (all being trade names of Kuraray Co., Ltd.); MPK polymers such as MPK-1, MPK-2, MPK-3, MPK-4, MPK-5, and MPK-6 (all being trade names of Kuraray Co., Ltd.); R polymers such as R-1130, R-2105, and R-2130 (all being trade names of Kuraray Co., Ltd.); and V polymers such as V-2250 (a trade name of Kuraray Co., Ltd.).

The viscosity of polyvinyl alcohol can be adjusted or stabilized by adding a trace amount of a solvent or an inorganic salt to an aqueous solution of polyvinyl alcohol, and there can be employed compounds described in the aforementioned reference "Poval", Koichi Nagano et al., published by Kobunshi Kankokai, pp. 144-154. For example, a coated-surface quality can be improved by an addition of boric acid. The amount of boric acid added is preferably 0.01 to 40 mass % with respect to polyvinyl alcohol.

Preferred binders are transparent or semitransparent, generally colorless, and water-soluble. Examples include natural resins, polymers and copolymers; synthetic resins, polymers, and copolymers; and other media that form films: for example, rubbers, polyvinyl alcohols, hydroxyethyl celluloses, cellulose acetates, cellulose acetate butylates, polyvinylpyrrolidones, starches, polyacrylic acids, polymethyl methacrylates, polyvinyl chlorides, polymethacrylic acids, styrene/maleic acid anhydride copolymers, styrene/acrylonitrile copolymers, styrene/butadiene copolymers, polyvinylacetals (e.g., polyvinylformals and polyvinylbutyrals), polyesters, polyurethanes, phenoxy resins, polyvinylidene chlorides, polyepoxides, polycarbonates, polyvinyl acetates, polyolefins, cellulose esters, and polyamides.

In the present invention, preferred water-soluble polymers are polyvinyl alcohols and gelatin, with gelatin being most preferred.

The amount of the water-soluble polymer added to the receptor layer is preferably from 1 to 25% by mass, more preferably from 1 to 10% by mass based on the entire mass of the receptor layer.

<Crosslinking Agent>

It is preferable that the above-mentioned water-soluble polymer contained in the receptor layer is partly or entirely crosslinked by a crosslinking agent.

The crosslinking agent is required to have a plurarity of groups capable of reacting with an amino group, a carboxyl group, a hydroxyl group, or the like, but the agent to be used may be suitably selected depending on the kind of the water-soluble polymer. Thus, there is no particular limitation for the kind of the crosslinking agent. It is suitable to use each of methods described in T. H. James; "THE THEORY OF THE PHOTOGRAPHIC PROCESS FOURTH EDITION", published by Macmillan Publishing Co., Inc. (1977), pp. 77-87, and crosslinking agents described in, for example, U.S. Pat. No. 4,678,739, col. 41; JP-A-59-116655, JP-A-62-245261, and JP-A-61-18942. Both crosslinking agents of an inorganic compound (e.g., chrome alum, boric acid and salts thereof) and crosslinking agents of an organic compound may be preferably used. Alternatively, the crosslinking agent to be used may be a mixture solution containing a chelating agent and a zirconium compound, whose pH is in the range of 1 to 7, as described in JP-A-2003-231775.

Specific examples of the crosslinking agent include epoxy-series compounds (e.g., diglycidyl ethyl ether, ethyleneglycol diglycidyl ether, 1,4-butanediol diglycidyl ether, 1,6-diglycidyl cyclohexane, N,N-diglycidyl-4-glycidyloxyaniline, sorbitol polyglycidyl ether, glycerol polyglycidyl ether, compounds described in JP-A-6-329877, JP-A-7-309954 and the like, and DIC FINE EM-60 (trade name, manufactured by DAINIPPON INK AND CHEMICALS, INCORPORATED)), aldehyde-series compounds (e.g., formaldehyde, glyoxal, gluralaldehyde), active halogen-series compounds (e.g., 2,4-dichloro-4-hydroxy-1,3,5-s-triazine, and compounds described in U.S. Pat. No. 3,325,287 and the like), active vinyl-series compounds (e.g., 1,3,5-trisacryloyl-hexahydro-s-triazine, bisvinylsulfonylmethyl ether, N,N'-ethylene-bis(vinylsulfonylactamido)ethane, and compounds described in JP-B-53-41220, JP-B-53-57257, JP-B-59-162546, JP-B-60-80846 and the like), mucohalogen acid compounds (e.g., mucochloric acid), N-carbamoylpyridinium salt compounds (e.g., (1-morpholinocarbonyl-3-pyridinio)methanesulfonate), haloamidinium salt compounds (e.g., 1-(1-chloro-1-pyridinomethylene)pyrrolidinium, 2-naphthalenesulfonate), N-methylol-series compounds (e.g., dimethylolurea, methyloldimethylhydantoin), carbodiimido compounds (e.g., polycarbodiimido compounds derived from isoholondiisocyanate as described in JP-A-59-187029 and JP-B-5-27450, carbodiimido compounds derived from tetramethylxylylene diisocyanate as described in JP-A-7-330849, multi-branch type carbodiimido compounds described in JP-A-10-30024, carbodiimido compounds derived from dicyclohexylmethane diisocyanate as described in JP-A-2000-7642, and CARBODILITE V-02, V-02-L2, V-04, V-06, E-01 and E-02 (trade names, manufactured by Nisshinbo Industries, Inc.)), oxazoline compounds (e.g., oxazoline compounds described in JP-A-2001-215653 and EPOCROS K-1010E, K-1020E, K-1030E, K-2010E, K-2020E, K-2030E, WS-500 and WS-706 (trade names, manufactured by NIPPON SHOKUBAI CO., LTD.)), isocyanate compounds (e.g., dispersible isocyanate compounds described in JP-A-7-304841, JP-A-8-277315, JP-A-10-45866, JP-A-9-71720, JP-A-9-328654, JP-A-9-104814, JP-A-2000-194045, JP-A-2000-194237 and JP-A-2003-64149, and Duranate WB40-100, WB40-80D, WT20-100 and WT30-100 (trade names, manufactured by Asahi Kasei Corporation), CR-60N (trade name, manufactured by DAINIPPON INK AND CHEMICALS, INCORPORATED)), polymer (high molecular) hardeners (e.g., compounds described in JP-A-62-234157 and the like); boric acid and salts thereof, borax, and alum.

Preferable compounds as the crosslinking agent include epoxy-series compounds, aldehyde-series compounds, active halogen-series compounds, active vinyl-series compounds, N-carbamoylpyridinium salt compounds, N-methylol-series compounds (e.g., dimethylolurea, methyloldimethylhydantoin), carbodiimido compounds, oxazoline compounds, isocyanate compounds, polymer hardeners (e.g., compounds described in JP-A-62-234157 and the like), boric acid and salts thereof, borax, and alum. More preferable crosslinking agents include epoxy-series compounds, active halogen-series compounds, active vinyl-series compounds, N-carbamoylpyridinium salt compounds, N-methylol-series compounds (e.g., dimethylolurea, methyloldimethylhydantoin), polymer hardeners (e.g., compounds described in JP-A-62-234157 and the like) and boric acid. The above-mentioned crosslinking agent may be used singly or in combination of two or more.

The crosslinking agent that can be used in the present invention may be added to the water-soluble polymer solution in advance, or may be added at the last step for the preparation of the coating solution. Alternatively, the crosslinking agent may be added just before the coating.

The water-soluble polymer in the receptor layer is preferably cross-linked in a ratio of from 0.1 to 20 mass %, more preferably from 1 to 10 mass %, among the entire water-soluble polymer, even though the ratio varies depending on the kind of the crosslinking agent.

The addition amount of the crosslinking agent that can be used in the present invention varies depending on the kinds of the water-soluble polymer and the crosslinking agent, but it is preferable that the amount is approximately in the range of from 0.1 to 50 mass parts, more preferably from 0.5 to 20 mass parts, and further more preferably from 1 to 10 mass parts, based on 100 mass parts of the water-soluble polymer contained in the constituting layer.

<Ultraviolet Absorber>

Also, in the present invention, in order to improve light resistance, an ultraviolet absorber may be added to the receptor layer. In this case, when this ultraviolet absorber is made to have a higher molecular weight, it can be secured to the receptor layer so that it can be prevented, for instance, from being diffused into the ink sheet and from being sublimated and vaporized by heating.

As the ultraviolet absorber, compounds having various ultraviolet absorber skeletons, which are widely used in the field of information recording, may be used. Specific examples of the ultraviolet absorber may include compounds having a 2-hydroxybenzotriazole type ultraviolet absorber skeleton, 2-hydroxybenzotriazine type ultraviolet absorber skeleton, or 2-hydroxybenzophenon type ultraviolet absorber skeleton. Compounds having a benzotriazole-type or triazine-type skeleton are preferable from the viewpoint of ultraviolet absorbing ability (absorption coefficient) and stability, and compounds having a benzotriazole-type or benzophenone-type skeleton are preferable from the viewpoint of obtaining a higher-molecular weight and using in a form of a latex. Specifically, ultraviolet absorbers described in, for example, JP-A-2004-361936 may be used.

The ultraviolet absorber preferably absorbs light at wavelengths in the ultraviolet region, and the absorption edge of the absorption of the ultraviolet absorber is preferably out of the visible region. Specifically, when it is added to the receptor layer to form a heat-sensitive transfer image-receiving sheet, the heat-sensitive transfer image-receiving sheet has a reflection density of, preferably, Abs 0.5 or more at 370 nm, and more preferably Abs 0.5 or more at 380 nm. Also, the heat-sensitive transfer image-receiving sheet has a reflection density of, preferably, Abs 0.1 or less at 400 nm. If the reflection density at a wavelength range exceeding 400 nm is high, it is not preferable because an image is made yellowish.

In the present invention, the ultraviolet absorber is preferably made to have a higher molecular weight. The ultraviolet absorber has a weight average molecular weight of preferably 10,000 or more, and more preferably 100,000 or more. As a means of obtaining a higher-molecular weight ultraviolet absorber, it is preferable to graft an ultraviolet absorber on a polymer. The polymer as the principal chain preferably has a polymer skeleton less capable of being dyed than the receptor polymer to be used together. Also, when the polymer is used to form a film, the film preferably has sufficient film strength. The graft ratio of the ultraviolet absorber to the polymer principal chain is preferably 5 to 20% by mass and more preferably 8 to 15% by mass.

Also, it is more preferable that the ultraviolet-absorber-grafted polymer is made to be used in a form of a latex. When the polymer is made to be used in a form of a latex, an aqueous dispersion-system coating solution may be used in application and coating to form the receptor layer, and this enables reduction of production cost. As a method of making the polymer latex (or making the polymer latex-wise), a method described in, for example, Japanese Patent No. 3,450,339 may be used. As the ultraviolet absorber to be used in a form of a latex, the following commercially available ultraviolet absorbers may be used which include ULS-700, ULS-1700, ULS-1383MA, ULS-1635MH, XL-7016, ULS-933LP, and ULS-935LH, manufactured by Ipposha Oil Industries Co., Ltd.; and New Coat UVA-1025W, New Coat UVA-204W, and New Coat UVA-4512M, manufactured by Shin-Nakamura Chemical Co., Ltd. (all of these names are trade names).

In the case of using an ultraviolet-absorber-grafted polymer in a form of a latex, it may be mixed with a latex of the receptor polymer capable of being dyed, and the resulting mixture is coated. By doing so, a receptor layer, in which the ultraviolet absorber is homogeneously dispersed, can be formed.

The addition amount of the ultraviolet-absorber-grafted polymer or its latex is preferably 5 to 50 parts by mass, and more preferably 10 to 30 parts by mass, to 100 parts by mass of the latex of the receptor polymer capable of being dyed to be used to form the receptor layer.

<Emulsified Dispersion>

In the present invention, it is preferred that the receptor layer contain an emulsified dispersion (emulsion). The term "emulsification" as used herein follows the commonly used definition. According to "Kagaku Daijiten (ENCYCLOPEDIA CHIMICA)", Kyoritsu Shuppan Co., Ltd., for example, "emulsification" is defined as "a phenomenon in which, in one liquid, another liquid which does not dissolve in the first liquid are dispersed as fine globules, to form an emulsion". In addition, the term "emulsified dispersion" refers to "a dispersion in which fine globules of one liquid are dispersed in another liquid which does not dissolve the globules". The "emulsified dispersion" preferred in the present invention is "a dispersion of oil globules in water". The content of an emulsified dispersion in the image-receiving sheet of the present invention is preferably from 0.03 g/m$^2$ to 25.0 g/m$^2$, more preferably from 1.0 g/m$^2$ to 20.0 g/m$^2$.

In the present invention, it is preferable that a high-boiling solvent be included as an oil-soluble substance in the emulsified dispersion. Examples of the high-boiling solvent preferably used include phthalic acid esters (such as dibutyl phthalate, dioctyl phthalate, and di-2-ethyl-hexyl phthalate), phosphoric or phosphonic acid esters (such as triphenyl phosphate, tricresyl phosphate, tri-2-ethylhexyl phosphate), fatty acid esters (such as di-2-ethylhexyl succinate and tributyl citrate), benzoic acid esters (such as 2-ethylhexyl benzoate and dodecylbenzoate), amides (such as N,N-diethyldodecanamide and N,N-dimethyloleinamide), alcohol and phenol compounds (such as isostearyl alcohol and 2,4-di-tert-amylphenol), anilines (such as N,N-dibutyl-2-butoxy-5-tert-octylaniline), chlorinated paraffins, hydrocarbons (such as dodecylbenzene and diisopropylnaphthalene), and carboxylic acids (such as 2-(2,4-di-tert-amylphenoxy)butyric acid). Of these high-boiling solvents, phosphoric or phosphonic acid esters (such as triphenyl phosphate, tricresyl phosphate, and tri-2-ethylhexyl phosphate) are preferred over the others. In addition to such a high-boiling solvent, an organic solvent having a boiling point of 30° C. to 160° C. (such as ethyl acetate, butyl acetate, methyl ethyl ketone, cyclohexanone, methyl cellosolve acetate, or dimethylformamide) may be used as an auxiliary solvent. The content of high-boiling solvent in the emulsified dispersion is preferably from 3.0 to 25% by mass, and more preferably from 5.0 to 20% by mass.

It is preferable that the emulsified dispersion further contain an agent for imparting fastness to images and an ultraviolet absorbent. The compounds preferably used as such agents are any of the compounds represented by formulae (B), (Ph), (E-1) to (E-3), (TS-I) to (TS-VII), (TS-VIIIA), (UA) to (UE) disclosed in JP-A-2004-361936. Further, homopolymers or copolymers insoluble in water and soluble in organic solvents (preferably the compounds disclosed in JP-A-2004-361936, paragraph Nos. 0208 to 0234) may be included therein.

<Releasing Agent>

Also, a releasing agent may be compounded in the receptor layer, in order to prevent thermal fusion with the heat-sensitive transfer sheet when an image is formed. As the releasing agent, a silicone oil, a phosphate-based plasticizer, or a fluorine-series compound may be used, and the silicone oil is particularly preferably used. As the silicone oil, modified silicone oil, such as epoxy-modified, alkyl-modified, amino-modified, carboxyl-modified, alcohol-modified, fluorine-modified, alkyl aralkyl polyether-modified, epoxy/polyether-modified, or polyether-modified silicone oil, is preferably used. Among these, a reaction product between vinyl-modified silicone oil and hydrogen-modified silicone oil is preferable. The amount of the releasing agent is preferably 0.2 to 30 parts by mass, to 100 parts by mass of the receptor polymer.

The amount of the receptor layer to be applied is preferably 0.5 to 10 g/m$^2$ (solid basis, hereinafter, the amount to be applied in the present specification means a value on a solid basis unless otherwise noted). The film thickness of the receptor layer is preferably 1 to 20 μm.

(Heat Insulation Layer)

A heat insulation layer serves to protect the support from heat when a thermal head is used to carry out a transfer operation under heating. Also, because the heat insulation layer has high cushion characteristics, a heat-sensitive transfer image-receiving sheet having high printing sensitivity can be obtained even in the case of using paper as a substrate (support). The heat insulation layer may be a single layer, or multi-layers. The heat insulation layer is arranged at a nearer location to the support than the receptor layer.

In the image-receiving sheet according to the present invention, the heat insulation layer contains hollow polymer particles.

The hollow polymer particles in the present invention are polymer particles having independent pores inside of the particles. Examples of the hollow polymer particles include (1) non-foaming type hollow particles obtained in the following manner: water is contained inside of a capsule wall formed of a polystyrene, acryl resin, or styrene/acryl resin and, after a coating solution is applied and dried, the water in the particles is vaporized out of the particles, with the result that the inside of each particle forms a hollow; (2) foaming type microballoons obtained in the following manner: a low-boiling point liquid such as butane and pentane is encapsulated in a resin constituted of any one of polyvinylidene chloride, polyacrylonitrile, polyacrylic acid and polyacrylate, and their mixture or polymer, and after the resin coating material is applied, it is heated to expand the low-boiling point liquid inside of the particles whereby the inside of each particle is made to be hollow; and (3) microballoons obtained by foaming the above (2) under heating in advance, to make hollow polymer particles.

These hollow polymer particles preferably have a hollow ratio of about 20 to 70%, and may be used in combinations of two or more. Specific examples of the above (1) include Rohpake 1055 manufactured by Rohm and Haas Co.; Boncoat PP-1000 manufactured by Dainippon Ink and Chemicals, Incorporated; SX866(B) manufactured by JSR Corporation; and Nippol MH5055 manufactured by Nippon Zeon (all of these product names are trade names). Specific examples of the above (2) include F-30 and F-50 manufactured by Matsumoto Yushi-Seiyaku Co., Ltd. (all of these product names are trade names). Specific examples of the above (3) include F-30E manufactured by Matsumoto Yushi-Seiyaku Co., Ltd, and Expancel 461DE, 551DE and 551DE20 manufactured by Nippon Ferrite (all of these product names are trade names). The hollow polymer particles for use in the heat insulation layer may be a latex thereof.

A water-dispersible resin or water-soluble resin is preferably contained, as a binder, in the heat insulation layer containing the hollow polymer. As the binder resin that can be used in the present invention, known resins such as an acryl resin, styrene/acryl copolymer, polystyrene resin, polyvinyl alcohol resin, vinyl acetate resin, ethylene/vinyl acetate copolymer, vinyl chloride/vinyl acetate copolymer, styrene/butadiene copolymer, polyvinylidene chloride resin, cellulose derivative, casein, starch, and gelatin may be used. Also, these resins may be used either singly or as mixtures.

The solid content of the hollow polymer particles in the heat insulation layer preferably falls in a range from 5 to 2,000 parts by mass when the solid content of the binder resin is 100 parts by mass. Also, the ratio by mass of the solid content of the hollow polymer particles in the coating solution is preferably 1 to 70% by mass and more preferably 10 to 40% by mass. If the ratio of the hollow polymer particles is excessively low, sufficient heat insulation cannot be obtained, whereas if the ratio of the hollow polymer particles is excessively large, the adhesion between the hollow polymer particles is reduced, posing problems, for example, powder fall or film separation.

The particle size of the hollow polymer particles is preferably 0.1 to 20 μm, more preferably 0.1 to 2 μm and particularly preferably 0.1 to 1 μm. Also, the glass transition temperature (Tg) of the hollow polymer particles is preferably 70° C. or more and more preferably 100° C. or more.

The heat insulation layer of the heat-sensitive transfer image-receiving sheet according to the present invention is preferably free of any resins having poor resistance to an organic solvent, except for the hollow polymer particles. Incorporation of the resin having poor resistance to an organic solvent (resin having a dye-dyeing affinity or a resin capable of being dyed) in the heat insulation layer is not preferable in view of increase in loss of image definition (i.e. increase in blurring) after image transfer. It is assumed that the color-edge definition loss (image blurring) increases by the reason that owing to the presence of both the resin having a dye-dyeing affinity and the hollow polymer particles in the heat insulation layer, a transferred dye that has dyed the receptor layer migrates through the heat insulation layer adjacent thereto at the lapse of time.

Herein, the term "poor resistance to an organic solvent" means that a solubility in an organic solvent is 1 mass % or more, preferably 0.5 mass % or more. For example, the above-mentioned polymer latex is included in the category of the resin having "poor resistance to an organic solvent".

The heat insulation layer preferably contains the above-mentioned water-soluble polymer. Preferable compounds of the water-soluble polymer are the same as mentioned above.

The amount of the water-soluble polymer to be added in the heat insulation layer is preferably from 1 to 75 mass %, more preferably from 1 to 50 mass % of the entire mass of the heat insulation layer.

The heat insulation layer preferably contains a gelatin. The amount of the gelatin in the coating solution for the heat insulation layer is preferably 0.5 to 14% by mass, and particularly preferably 1 to 6% by mass. Also, the coating amount of the above hollow polymer particles in the heat insulation layer is preferably 1 to 100 g/m$^2$, and more preferably 5 to 20 g/m$^2$.

The water-soluble polymer that is contained in the heat insulation layer is preferably cross-linked with a crosslinking agent. Preferable compounds as well as a preferable amount of the crosslinking agent to be used are the same as mentioned above.

A preferred ratio of a cross-linked water-soluble polymer in the heat insulation layer varies depending on the kind of the crosslinking agent, but the water-soluble polymer in the heat insulation layer is crosslinked by preferably 0.1 to 20 mass %, more preferably 1 to 10 mass %, based on the entire water-soluble polymer.

A thickness of the heat insulation layer containing the hollow polymer particles is preferably from 5 to 50 μm, more preferably from 5 to 40 μm.

(Undercoat Layer)

An undercoat layer may be formed between the receptor layer and the heat insulation layer. As the undercoat layer, for example, a white background regulation layer, a charge regulation layer, an adhesive layer or a primer layer is formed. These layers may be formed in the same manner as those described in, for example, each specification of Japanese Patent Nos. 3,585,599 and 2,925,244.

(Support)

The support for use in the present invention has a structure in which a resin layer is provided either on both sides or on at least the receptor-layer-provided side of a base paper (base sheet).

In the following, the support for use in the first embodiment of the present invention will be explained.

Detrimental effects of use of polypropylene in the foregoing resin layer have been found, and based on this finding the first embodiment of the present invention was accomplished. It is a preferred embodiment of the first embodiment of the present invention to stick a biaxially stretched polyester film on a base paper with an adhesive. Alternatively, the resin layer may be provided on a paper support by melt extrusion.

For the resin layer provided on the base paper surface for use in the first embodiment of the present invention, it is preferable to use a resin other than polypropylene, for example, a polyethylene terephthalate, a polyethylene naphthalate, a polyester, or a polycarbonate.

The resin layer on the base paper surface according to the first embodiment of the present invention is preferably provided by sticking (bonding) a biaxially stretched microvoid film not containing polypropylene but containing polyethylene terephthalate, polyethylene naphthalate, polyester, or polycarbonate, as its component.

When forming microvoids (microscopic holes) in such a resin, it is preferable to use a material capable of inducing voids. Such a material is preferably a polymeric material. This polymeric material is preferably a polymer which can be melt-mixed with a polymer for forming the core matrix and can form dispersed spherical particles when the resulting suspension is cooled. An example is a polypropylene dispersed in a polyethylene terephthalate. The material capable of inducing voids is preferably used in an amount corresponding to 5 to 50 mass % of the matrix polymer used to form a core. The particles of the void-inducing material remaining in the completed sheet core are generally from 0.1 to 10 μm in diameter, and preferably spherical in shape. The sizes of voids, though depend on the extents of stretch in length and width directions, are roughly the cross-sectional diameters of particles which formed the voids.

As a method of bonding the biaxially stretched microvoid film and base paper together, known lamination methods, such as a dry lamination method, a non-solvent (hot melt) lamination method, and an EC lamination method, can be adopted. Of these methods, a dry lamination method and a non-solvent lamination method are preferred. Examples of an adhesive suitable for a non-solvent lamination method are Takelac A969 and Takenate A-5 (trade names, manufactured by Takeda Pharmaceutical Company Limited). These adhesives are used in amounts of about 2 to 7 g/m$^2$ in terms of a solid content.

In the first embodiment of the present invention, the resins and the additives as disclosed in JP-A-2004-271790, paragraph Nos. 0031 to 0048, can be used according to the intended purpose.

In the following, the support for use in the second embodiment of the present invention will be explained.

Examples of a resin usable for the resin layer according to the second embodiment of the present invention include known resins, such as polyethylene and polypropylene. The second embodiment of the present invention is characterized by its use of no adhesive at the time of providing a resin layer on a base paper. It is preferable that the resin layer be formed on a paper support by melt extrusion.

Examples of a resin preferable for the resin layer on a base paper, according to the second embodiment of the present invention, include polyolefin resins, such as homopolymers of α-olefins (e.g., polyethylene, polypropylene) and mixtures thereof. These polyolefin resins are not particularly subjected to restrictions on their molecular weights as far as extrusion coating can be employed, and any one of the polyolefin resins can be selected appropriately according to the intended purposes. Polyolefin resins ranging in molecular weight from 20,000 to 200,000 are particularly preferable. In the second embodiment of the present invention, the resins and the additives as disclosed in JP-A-2004-271790, paragraph Nos. 0031 to 0048, can be used according to the intended purpose.

In the second embodiment of the present invention, a coated paper and a laminated paper may be used as the support having a base paper on which a resin layer is provided.

—Coated Paper—

The coated paper is paper obtained by coating a sheet such as base paper with various resins, rubber latexes, or high-molecular materials, on one side or both sides of the sheet, wherein the coating amount differs depending on its use. Examples of such coated paper include art paper, cast coated paper, and Yankee paper.

It is proper to use a thermoplastic resin as the resin to be applied to the surface(s) of the base paper. As such a thermoplastic resin, the following thermoplastic resins (A) to (H) may be exemplified.

(A) Polyolefin resins such as polyethylene resin and polypropylene resin; copolymer resins composed of an olefin such as ethylene or propylene and another vinyl monomer; and acrylic resin.

(B) Thermoplastic resins having an ester linkage: for example, polyester resins obtained by condensation of a dicarboxylic acid component (such a dicarboxylic acid component may be substituted with a sulfonic acid group, a carboxyl group, or the like) and an alcohol component (such an alcohol component may be substituted with a hydroxyl group, or the like); polyacrylate resins or polymethacrylate resins such as polymethylmethacrylate, polybutylmethacrylate, polymethylacrylate, polybutylacrylate, or the like; polycarbonate resins, polyvinyl acetate resins, styrene acrylate resins, styrene-methacrylate copolymer resins, vinyltoluene acrylate resins, or the like.

Concrete examples of them are those described in JP-A-59-101395, JP-A-63-7971, JP-A-63-7972, JP-A-63-7973, and JP-A-60-294862.

Commercially available thermoplastic resins usable herein are, for example, Vylon 290, Vylon 200, Vylon 280, Vylon 300, Vylon 103, Vylon GK-140, and Vylon GK-130 (products of Toyobo Co., Ltd.); Tafton NE-382, Tafton U-5, ATR-2009, and ATR-2010 (products of Kao Corporation); Elitel UE 3500, UE 3210, XA-8153, KZA-7049, and KZA-1449 (products of Unitika Ltd.); and Polyester TP-220 and R-188 (products of The Nippon Synthetic Chemical Industry Co., Ltd.); and thermoplastic resins in the Hyros series from Seiko Chemical Industries Co., Ltd., and the like (all of these names are trade names).

(C) Polyurethane resins, etc.

(D) Polyamide resins, urea resins, etc.

(E) Polysulfone resins, etc.

(F) Polyvinyl chloride resins, polyvinylidene chloride resins, vinyl chloride/vinyl acetate copolymer resins, vinyl chloride/vinyl propionate copolymer resins, etc.

(G) Polyol resins such as polyvinyl butyral; and cellulose resins such as ethyl cellulose resin and cellulose acetate resin, and (H) Polycaprolactone resins, styrene/maleic anhydride resins, polyacrylonitrile resins, polyether resins, epoxy resins, and phenolic resins.

The thermoplastic resins may be used either alone or in combination of two or more.

The thermoplastic resin may contain a whitener, a conductive agent, a filler, a pigment or dye including, for example, titanium oxide, ultramarine blue, and carbon black; or the like, if necessary.

—Laminated Paper—

The laminated paper is a paper which is formed by laminating various kinds of resin, rubber, polymer sheets or films on a sheet such as a base paper or the like. Specific examples of the materials useable for the lamination include polyolefins, polyvinyl chlorides, polyethylene terephthalates, polystyrenes, polymethacrylates, polycarbonates, polyimides, and triacetylcelluloses. These resins may be used alone, or in combination of two or more.

Generally, the polyolefins are prepared by using a low-density polyethylene. However, for improving the thermal resistance of the support, it is preferred to use a polypropylene, a blend of a polypropylene and a polyethylene, a high-density polyethylene, or a blend of a high-density polyethylene and a low-density polyethylene. From the viewpoint of cost and its suitableness for the laminate, it is preferred to use the blend of a high-density polyethylene and a low-density polyethylene.

The blend of a high-density polyethylene and a low-density polyethylene is preferably used in a blend ratio (a mass ratio) of 1/9 to 9/1, more preferably 2/8 to 8/2, and most preferably 3/7 to 7/3. When the thermoplastic resin layer is formed on the both surfaces of the support, the back side of the support is preferably formed using, for example, the high-density polyethylene or the blend of a high-density polyethylene and a low-density polyethylene. There is no particular limitation on the molecular weight of polyethylene, but the high-density polyethylene or the low-density polyethylene is preferably a polyethylene having a melt index in the range of 1.0 to 40 g/10 min and having extrusion suitability. Particularly preferred is a polyethylene having a molecular weight in the range of 20,000 to 200,000. In the second embodiment of the present invention, the resins and the additives as disclosed in JP-A-2004-271790, paragraph Nos. 0031 to 0048, can be used appropriately according to the intended purpose.

The following features are commonly applicable to the supports for use in the first and second embodiments of the present invention.

The base paper for use in the present invention has no particular restriction as to its raw material, and can be made from natural pulp chosen from softwood pulp or hardwood pulp, synthetic pulp derived from a plastic material such as polyethylene or polypropylene, or a mixture of natural pulp and synthetic pulp.

As the pulp used as a raw material for the base paper, broad-leaved tree bleached kraft pulp (LBKP) is preferred from the viewpoint of simultaneously improving surface smoothness, stiffness (rigidity), and dimensional stability (anti-curl) of base paper in a well-balanced state and to sufficient levels. It is also possible to use needle-leaved bleached kraft pulp (NBKP) and broad-leaved tree sulfite pulp (LBSP). However, it is appropriate that broad-leaved tree pulp inherently short in fiber length be used for a main constituent of pulp fiber. For beating of pulp, a beater or a refiner can be used. To the pulp slurry obtained after beating of pulp, various kinds of additives, such as a filler, a dry paper durability enhancing agent, a sizing agent, a wet paper durability enhancing agent, a fixer, a pH adjuster, and other chemicals, can be added. Examples of these additives include the same ones as disclosed in JP-A-2004-271790, paragraph Nos. 0021 to 0025.

The density of the base paper is preferably 0.9 g/m$^3$ or more, more preferably from 0.95 g/m$^3$ to 1.2 g/m$^3$. The thickness of the base paper, though can be chosen appropriately according to the desired purpose, is preferably from 50 to 300 μm, more preferably from 100 to 250 μm, in usual cases.

The basis weight (grammage) of the base paper has no particular limitation but can be chosen according to the desired purpose. Specifically, it is preferably from 50 to 250 g/m$^2$, particularly preferably from 100 to 200 g/m$^2$.

Moreover, it is preferable that a curling control layer, a writing layer, and a charge control layer be formed on the back side of the support for use in the present invention. Each layer can be applied using a usual method such as roll coating, bar coating, gravure coating, and gravure reverse coating.

The sheet or film may be subjected to a treatment to impart white reflection thereto. As a method of such a treatment, for example, a method of incorporating a pigment such as titanium oxide into the sheet or film can be mentioned.

The thickness of the support for use in the present invention is preferably from 25 μm to 300 μm, more preferably from 50 μm to 260 μm, and further preferably from 75 μm to 220 μm. The support can have any rigidity according to the purpose. When it is used as a support for electrophotographic image-receiving sheet of photographic image quality, the rigidity thereof is preferably near to that in a support for use in color silver halide photography.

It is preferable that the surface of a support for use in the present invention on the side to be provided with a receptor layer have a Bekk smoothness of 10,000 seconds or more and a center-line average roughness (Ra) of 0.5 μm or less. It is far preferable that the surface of a support for use in the present invention on the side to be provided with a receptor layer have a Bekk smoothness of 15,000 seconds or more and a center-line average roughness (Ra) of 0.4 μm or below. On the side to be provided with a backing layer (i.e. the side opposite to the side having a receptor layer), it is preferable that the surface of a support for use in the present invention have a Bekk smoothness of 1,300 seconds or less, a center-line average roughness (Ra) of 0.75 μm to 10 μm, and a localized-area average peak spacing (S) of 30 μm to 75 μm.

Herein, the Bekk smoothness can be measured with a Bekk smoothness tester conforming to JIS P8119. Further, the center-line average roughness (Ra) and the localized-area average peak spacing (S) are based on the surface roughness definitions in JIS B0601, and these values can be measured with, for example, a surface profile analyzer.

(Curling Control Layer)

When the support is exposed as it is, there is the case where the heat-sensitive transfer image-receiving sheet is made to curl by moisture and/on temperature in the environment. It is therefore preferable to form a curling control layer on the back side of the support. The curling control layer not only prevents the image-receiving sheet from curling but also has a water-proof function. For the curling control layer, a polyethylene laminate, a polypropylene laminate or the like is used. Specifically, the curling control layer may be formed in a manner similar to those described in, for example, JP-A-61-110135 and JP-A-6-202295.

(Writing Layer and Charge Controlling Layer)

For the writing layer and the charge control layer, an inorganic oxide colloid, an ionic polymer, or the like may be used. As the antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge control layer may be formed in a manner similar to those described in the specification of Japanese Patent No. 3585585.

The method of producing the heat-sensitive transfer image-receiving sheet according to the present invention is explained below.

The heat-sensitive transfer image-receiving sheet according to the present invention may be prepared by coating each of layers using a usual method such as a roll coating, a bar coating, a gravure coating, and a gravure reverse coating, followed by drying the layers.

Alternatively, the heat-sensitive transfer image-receiving sheet according to the present invention may be also prepared by simultaneous multi-layer coating the receptor layer and the heat insulation layer on the support.

It is known that in the case of producing an image-receiving sheet composed of plural layers having different functions from each other (for example, an air cell layer, heat insulation layer, intermediate layer, and receptor layer) on a support, it may be produced by applying and overlapping each layer one by one or by applying materials prepared in advance by coating a support with each layer, as shown in, for example, JP-A-2004-106283, JP-A-2004-181888 and JP-A-2004-345267. It has been known in photographic industries, on the other hand, that productivity can be greatly improved by applying plural layers simultaneously as a multilayer. For example, there are known methods such as the so-called slide coating (slide coating method) and curtain coating (curtain coating method) as described in, for example, U.S. Pat. Nos. 2,761,791, 2,681,234, 3,508,947, 4,457,256 and 3,993,019; JP-A-63-54975, JP-A-61-278848, JP-A-55-86557, JP-A-52-31727, JP-A-55-142565, JP-A-50-43140, JP-A-63-80872, JP-A-54-54020, JP-A-5-104061, JP-A-5-127305, and JP-B-49-7050; and Edgar B. Gutoff, et al., "Coating and Drying Defects: Troubleshooting Operating Problems", John Wiley & Sons Company, 1995, pp. 101-103.

In the present invention, it has been found that the productivity is greatly improved and image defects can be remarkably reduced at the same time, by using the above simultaneous multilayer coating for the production of an image-receiving sheet having a multilayer structure.

The plural layers in the present invention are structured using resins as their major components. Coating solutions for forming the respective layers are preferably water-dispersed latexes (latexes in the form of aqueous dispersion). The solid content by mass of the resin put in a latex state in each layer coating solution is preferably in a range from 5 to 80% and particularly preferably 20 to 60%. The average particle size of the resin contained in the above water-dispersed latex is preferably 5 μm or less and particularly preferably 1 μm or less. The above water-dispersed latex may contain a known additive, such as a surfactant, a dispersant, and a binder resin, according to the need.

In the present invention, it is preferred that a laminate composed of plural layers be formed on a support and solidified just after the forming, according to the method described in U.S. Pat. No. 2,761,791. For example, in the case of solidifying a multilayer structure by using a resin, it is preferable to raise the temperature immediately after the plural layers are formed on the support. Also, in the case where a binder (e.g., a gelatin) which causes gelation at lower temperatures is contained, it is sometimes preferable to drop the temperature immediately after the plural layers are formed on the support.

In the present invention, the coating amount of a coating solution per one layer constituting the multilayer is preferably in a range from 1 g/m$^2$ to 500 g/m$^2$. The number of layers in the multilayer structure may be arbitrarily selected from a number of 2 or more. The receptor layer is preferably disposed as a layer most apart from the support.

It is preferable that the heat-sensitive transfer image-receiving sheet of the present invention has a moderate elasticity modulus. For example, it is preferable for the heat-sensitive transfer image-receiving sheet to have an elasticity modulus of 10% to 30% as measured by the method described in JP-A-2002-200851.

The heat-sensitive transfer image-receiving sheet of the present invention is preferably smooth. The smoothness thereof is preferably 700 seconds or more, particularly preferably 2,000 seconds or more, as given in Bekk smoothness.

The heat-sensitive transfer image-receiving sheet of the invention preferably has moderate stiffness. For instance, the preferable stiffness thereof is from 500 to 1,500 standard Gurley units as given in the stiffness defined by TAPPI T543 84.

In addition, it is required for the heat-sensitive transfer image-receiving sheet of the present invention to have an appropriate coefficient of static friction on rubber rollers for transport use, and it is preferable that the coefficient of static friction between at least one side of the present heat-sensitive transfer image-receiving sheet and each rubber roller is 0.5 or more.

A heat-sensitive transfer sheet (ink sheet) to be used together with the aforementioned heat-sensitive transfer image-receiving sheet according to the present invention in the formation of a thermal-transferred image, can be produced by disposing a dye layer containing a diffusion transfer dye on a support. As the heat-sensitive transfer sheet, any ink sheet may be used. As a means for providing heat energy in the thermal transfer, any of the conventionally known providing means may be used. For example, a heat energy of about 5 to 100 mJ/mm$^2$ is applied by controlling recording time in a recording device such as a thermal printer (trade name: Video Printer VY-100, manufactured by Hitachi, Ltd.), whereby the expected object can be attained sufficiently.

Also, the heat-sensitive transfer image-receiving sheet according to the present invention may be used in various applications enabling thermal transfer recording, such as heat-sensitive transfer image-receiving sheets in a form of thin sheets (cut sheets) or rolls; cards; and transmittable type manuscript-making sheets, by optionally selecting the type of support.

The present invention may be utilized for printers, copying machines and the like, which employ a heat-sensitive transfer recording system.

The heat-sensitive transfer image-receiving sheet of the present invention can be provided in the form of a roll with a paper core or a plastic core, or it can be provided in the form of a roll without any core. Alternatively, it may be provided in sheet form.

The heat-sensitive transfer image-receiving sheet according to the first embodiment of the present invention gives high transfer density and is excellent in image preservability. Further, the heat-sensitive transfer image-receiving sheet according to the first embodiment of the present invention can be manufactured at low costs while attaining the performance mentioned above.

Further, the heat-sensitive transfer image-receiving sheet according to the second embodiment of the present invention gives high transfer density and is reduced in image defects resulting from internal contamination of a printer, and it can be prepared at low costs.

The present invention will be described in more detail based on the following examples, but the invention is not intended to be limited thereto.

EXAMPLES

In the following examples, the terms "part" and "%" are values by mass, unless they are indicated differently in particular.

Reference Example

Production of an Ink Sheet

A polyester film 6.0 μm in thickness (trade name: Lumirror, manufactured by Toray Industries, Inc.) was used as the support film. A heat-resistant slip layer (thickness: 1 μm) was formed on the back side of the film, and the following yellow, magenta, and cyan compositions were respectively applied as a monochromatic layer (coating amount: 1 g/m$^2$ when the layer was dried) on the front side.

| Yellow composition | |
|---|---|
| Dye (trade name: Macrolex Yellow 6G, manufactured by Byer) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |
| **Magenta composition** | |
| Magenta dye (Disperse Red 60) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |
| **Cyan composition** | |
| Cyan dye (Solvent Blue 63) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |

Example 1

Preparation of Image-Receiving Sheets (Preparation of Supports)

Preparation of Support 1

A pulp slurry was prepared from 50 parts by mass of hardwood kraft pulp (LBKP) of acacia origin and 50 parts by mass of hardwood kraft pulp (LBKP) of aspen origin, by beating these pulps by means of a disk refiner until Canadian standard freeness reached to 300 ml.

To the pulp slurry thus prepared were added, on pulp basis, 1.3% of modified cationic starch (CAT0304L, trade name, manufactured by Nippon NSC), 0.15% of anionic polyacrylamide (DA4104, trade name, manufactured by Seiko PMC Corporation), 0.29% of alkylketene dimer (SIZEPINE K, trade name, manufactured by Arakawa Chemical Industries, Ltd.), 0.29% of epoxidated behenic acid amide, and 0.32% of polyamide polyamine epichlorohydrin (ARAFIX 100, trade name, manufactured by Arakawa Chemical Industries, Ltd.), and thereafter 0.12% of a defoaming agent was further added.

The resulting pulp slurry was made into paper by use of a fourdrinier paper machine. In a process of drying in which the felt side of web was pressed against a drum dryer cylinder via a dryer canvas, the web thus formed was dried under a condition that the tensile strength of the dryer canvas was adjusted to 1.6 kg/cm. Then, each side of the raw paper thus made was coated with 1 g/m$^2$ of polyvinyl alcohol (KL-118, trade name, manufactured by Kuraray Co., Ltd.) with a size press, then, dried and further subjected to calendering treatment. Therein, the papermaking was performed so that the raw paper had a grammage (basis weight) of 157 g/m$^2$, and the raw paper (base paper) having a thickness of 160 μm was obtained.

While this base paper was made to travel at a speed of 150 m/min, the back side thereof was subjected to corona discharge treatment, and on the thus treated back side a 10 μm-thick layer made up of 10 parts of a low-density polyethylene (density: 0.924 g/m$^3$, MI=3 g/10 min) and 90 parts of a high-density polyethylene (density: 0.966 g/m$^3$, MI=11 g/10 min) and a 15 μm-thick outermost layer made up of 50 parts of a low-density polyethylene (density: 0.922 g/m$^3$, MI=5 g/10 min) and 50 parts of a high-density polyethylene (density: 0.970 g/m$^3$, MI=20 g/10 min) were coated simultaneously by melt extrusion using a coat hanger type die for co-extrusion of two layers, and immediately thereafter a pattern was embossed on the outermost layer by use of a chill roll having a matt surface whose center-line average roughness (Ra) and cooling temperature were adjusted appropriately, thus forming a matt resin layer.

Further, the front side of the base paper was subjected to corona discharge treatment, and then provided with a glossy resin layer by coating two 15 μm-thick layers made from a low-density polyethylene (density: 0.920 g/m$^3$, MI=5 g/10 min) by melt extrusion using a coat hanger type die for co-extrusion of two layers, and immediately thereafter embossing a pattern on the upper layer by use of a chill roll having a fine matt surface whose average roughness and cooling temperature were adjusted appropriately, thereby forming a matt resin layer.

In succession thereto, a topcoat was formed by applying a coating solution following the formula described below in an amount of 9 ml/m$^2$, followed by drying at 50° C.

| Coating solution for topcoat | |
|---|---|
| MH5055 (hollow polymer, produced by Zeon Corporation) | 100 parts by mass |
| 7% Hot aqueous solution of PVA | 100 parts by mass |

The thus made support was referred to as Support 1.

Preparation of Support 2

On the front side of the base paper as used in Support 1, instead of providing the polyethylene layers and applying the coating solution for the topcoat, a resin film was stuck uniformly by the following process. More specifically, the front side of the base paper was subjected to corona discharge treatment, and then the thus-treated front side was coated with 3 g/m$^2$ of an adhesive prepared by mixing a multifunctional polyol (Takelac A-969V (trade name), manufactured by Takeda Pharmaceutical Company Limited), an isocyanate (Takenate A-5 (trade name), manufactured by Takeda Pharmaceutical Company Limited), and ethyl acetate at a ratio of 3:1:6 (by mass), and further thereon was stuck a 100 μm-thick biaxially stretched polyester film (Toyobo Ester Film E5100 (trade name), manufactured by Toyobo Co., Ltd.).

Preparation of Support 3

Instead of Toyobo Ester Film E5100 used for Support 2, Teijin Tetoron Film U2 (trade name, a 100 μm-thick biaxially stretched polyester film, manufactured by Teijin DuPont Films Japan Limited) was stuck to prepare Support 3.

Preparation of Support 4

Instead of Toyobo Ester Film E5100 used for Support 2, FPG (trade name, a 110 μm-thick biaxially stretched polypropylene film, manufactured by Yupo Corporation) was stuck to prepare Support 4.

Preparation of Support 5

Instead of Toyobo Ester Film E5100 used for Support 2, Teonex Q65 (trade name, a 100 μm-thick biaxially stretched polyethylene naphthalate film, manufactured by Teijin DuPont Films Japan Limited) was stuck to prepare Support 5.

Preparation of Support 6

Instead of Toyobo Ester Film E5100 used for Support 2, Lumirror E60V (trade name, a 194 μm-thick biaxially stretched polyester film, manufactured by Toray Industries Inc.) was stuck to prepare Support 6.

In the manners mentioned above, Supports 1 to 6 were prepared.

TABLE 1

Supports used in the samples

| Support No. | Kinds of film |
|---|---|
| Support 1 | Polyethylene and Hollow polymer particles |
| Support 2 | Biaxially-stretched polyester |
| Support 3 | Biaxially-stretched polyester |
| Support 4 | Biaxially-stretched polypropylene |
| Support 5 | Biaxially-stretched polyethylene naphthalate |
| Support 6 | Biaxially-stretched polyester film |

(Preparation of Emulsified Dispersion)

An emulsified dispersion A was prepared in the following manner. A compound A-6, which will be shown below, was dissolved in a mixture of 42 g of a high-boiling solvent (Solv-1) and 20 ml of ethyl acetate, and the resulting solution was emulsified and dispersed in 250 g of a 20 mass % aqueous gelatin solution containing 1 g of sodium dodecylbenzenesulfonate by means of a high-speed-stirring emulsification machine (dissolver). Thereto, water was added to prepare 380 g of an emulsified dispersion A.

In the above, the addition amount of compound A-6 was adjusted so that the compound would be contained in an amount of 30 mmol in the emulsified dispersion A.

(Preparation of Image-Receiving Sheets)

On each of the supports prepared in the foregoing manner was formed a multilayer coating consisting of a subbing layer 1, a subbing layer 2, a heat insulation layer, and a receptor layer, which were stacked on top of each other in the order described. The compositions and coating amounts of coating solutions used therein are shown below.

| Coating solution for subbing layer 1 | |
|---|---|
| (Composition) | |
| Aqueous solution prepared by adding 1% sodium dodecylbenzenesulfonate to 3% aqueous gelatin solution | |
| NaOH for adjusting pH to 8 | |
| (Coating amount) | 11 ml/m$^2$ |
| Coating solution for subbing layer 2 | |
| (Composition) | |
| Styrene-butadiene latex (SR103 (trade name), manufactured by Nippon A & L Inc.) | 60 parts by mass |

-continued

| | |
|---|---|
| 6% Aqueous solution of polyvinyl alcohol (PVA) | 40 parts by mass |
| NaOH for adjusting pH to 8 | |
| (Coating amount) | 11 ml/m$^2$ |
| Coating solution for heat insulation layer | |
| (Composition) | |
| Hollow polymer latex (MH5055 (trade name), manufactured by Zeon Corporation) | 60 parts by mass |
| 10% Gelatin aqueous solution | 20 parts by mass |
| Emulsified dispersion A prepared in the above | 20 parts by mass |
| NaOH for adjusting pH to 8 | |
| (Coating amount) | 45 ml/m$^2$ |
| Coating solution for receptor layer | |
| (Composition) | |
| Vinyl chloride-acrylate copolymer latex (Vinyblan 900 (trade name), manufactured by Nissin Chemical Industry Co., Ltd.) | 70 parts by mass |
| 10% Gelatin aqueous solution | 10 parts by mass |
| Emulsified dispersion A prepared in the above | 10 parts by mass |
| Microcrystalline wax (EMUSTAR-42X (trade name), manufactured by Nippon Seiro Co., Ltd.) | 5 parts by mass |
| Water | 5 parts by mass |
| NaOH for adjusting pH to 8 | |
| (Coating amount) | 18 ml/m$^2$ |

A-6

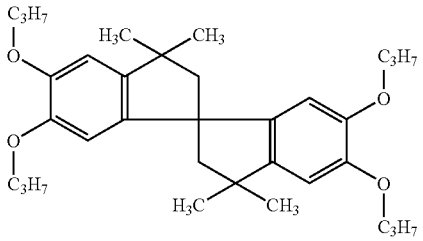

Solv-1

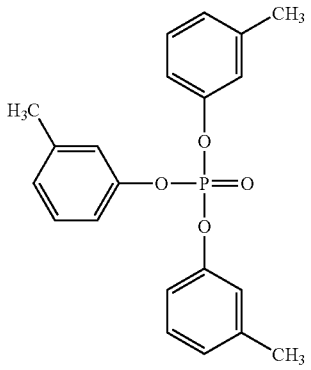

Preparation of Samples 101 to 112

Samples 101 to 106 were prepared by giving simultaneous multilayer coating to the supports 1 to 6, respectively, so that a triple-layer structure having a subbing layer 1, a subbing layer 2, and a receptor layer, described in the increasing order of distance from the support, was formed on each support and the coating amount of the subbing layers 1 and 2 each was adjusted to 11 ml/m$^2$ and that of the receptor layer was adjusted to 18 ml/m$^2$. Samples 107 to 112 were prepared by simultaneous multilayer coating in the same manners as Samples 101 to 106, respectively, except that the heat insulation layer was provided between the subbing layer 2 and the receptor layer and that the coating amount thereof was adjusted to 45 ml/m$^2$.

(Image Formation)

The ink sheet prepared in the reference example and the image-receiving sheets of Samples 101 to 112 were each worked to be made loadable in a sublimation printer, DPB 1500 (trade name, manufactured by Nidec Copal Corporation), and image outputs were produced on those image-receiving sheets in settings that permit production of all the gradations (shades) of gray from the minimum density to the maximum density in a high-speed printing mode. Herein, output of one L-size print took 13 seconds.

(Dmax Evaluation)

Visual densities of the black images obtained under the foregoing conditions were measured with a Photographic Densitometer (manufactured by X-Rite Incorporated). Each sample was evaluated for its maximum density Dmax.

(Image Preservability)

After one-month storage of each sample at 60° C. as a condition for forced long-term aging (storage) of images, the resulting images were observed visually and the degree of bleeding developed therein (blurring) was evaluated.

The degrees of bleeding from black lines having a line width of 0.5 mm and a density of 2 or more were rated on a 1-to-5 scale by sensory evaluation. After storage, the width of the black lines at the portion where the density was 0.5 or more was measured. The cases where those black lines thickened to reach width of 2.5 mm or more were given 1 point, the cases where those black lines thickened to reach a width of 2 mm or more but less than 2.5 mm were given 2 points, the cases where those black lines thickened to reach a width of 1.5 mm or more but less than 2 mm were given 3 points, the cases where those black lines thickened to reach a width of 1 mm or more but less than 1.5 mm were given 4 points, and the cases where those black lines thickened to reach a width of less than 1 mm were given 5 points.

The results obtained are shown in Table 2.

TABLE 2

Details of the samples used in the evaluations and results thereof

| Sample No. | Support No. | Kinds of film | Hollow-polymer-particle-containing heat insulation layer | Dmax | Image blurring | Remarks |
|---|---|---|---|---|---|---|
| 101 | Support 1 | Polyethylene and Hollow polymer particles | Absent | 1.93 | 1 | Comparative example |
| 102 | Support 2 | Biaxially-stretched polyester | Absent | 1.95 | 2 | Comparative example |
| 103 | Support 3 | Biaxially-stretched polyester | Absent | 1.97 | 2 | Comparative example |
| 104 | Support 4 | Biaxially-stretched polypropylene | Absent | 1.95 | 2 | Comparative example |
| 105 | Support 5 | Biaxially-stretched polyethylene naphthalate | Absent | 1.97 | 2 | Comparative example |
| 106 | Support 6 | Biaxially-stretched polyester film | Absent | 1.97 | 2 | Comparative example |
| 107 | Support 1 | Polyethylene and Hollow polymer particles | Present | 2.25 | 5 | This invention |
| 108 | Support 2 | Biaxially-stretched polyester | Present | 2.26 | 5 | This invention |
| 109 | Support 3 | Biaxially-stretched polyester | Present | 2.23 | 5 | This invention |
| 110 | Support 4 | Biaxially-stretched polypropylene | Present | 2.14 | 3 | Comparative example |
| 111 | Support 5 | Biaxially-stretched polyethylene naphthalate | Present | 2.23 | 5 | This invention |
| 112 | Support 6 | Biaxially-stretched polyester film | Present | 2.23 | 5 | This invention |

As is apparent from the results shown in Table 2, Dmax values were increased by providing the heat insulation layers containing hollow polymer particles. However, Sample 110 (comparative example) provided with the support which used polypropylene was reduced in Dmax-increasing effect of the heat insulation layer containing hollow polymer particles. In contrast thereto, Samples 107 to 109 and 111 and 112 (according to the present invention) having supports which did not use polypropylene gave high Dmax values and caused slight bleeding of images by storage.

Example 2

Preparation of Image-Receiving Sheets (Preparation of Supports)

Preparation of Support 7

Support 7 was prepared in the same manner as Support 1 in Example 1, except that the topcoat coating solution was not applied. Support 7 had two polyethylene layers on the front side of the base paper.

Preparation of Support 8

Instead of providing the polyethylene layers on the front side of the base paper of the foregoing support 7, a 30 μm-thick polyester film was laminated evenly in the following manner. Specifically, the front side of the base paper was subjected to corona discharge treatment, and then coated with 3 g/m$^2$ of an adhesive prepared by mixing a multifunctional polyol (Takelac A-969V (trade name), manufactured by Takeda Pharmaceutical Company Limited), an isocyanate (Takenate A-5 (trade name), manufactured by Takeda Pharmaceutical Company Limited), and ethyl acetate, at a ratio of 3:1:6 (by mass), and further thereon was stuck a 30 μm-thick commercially available polyester film.

Preparation of Support 9

As the adhesive used in the step of providing the polyester film on the front side of the base paper of the foregoing support 8, a mixture of an acrylic copolymer (SK Dyne 1310 (trade name), manufactured by Soken Chemical & Engineering Co., Ltd.), an epoxy resin, and ethyl acetate was applied in an amount of 3 g/m$^2$, and therewith a 30 μm-thick commercially available polyester film was stuck on the base paper.

In the foregoing manners, supports 7 to 9 were obtained.

TABLE 3

Supports used in samples

| Support No. | Adhesive |
|---|---|
| Support 7 | Absent |
| Support 8 | Present |
| Support 9 | Present |

(Preparation of Image-Receiving Sheets)

In the same manner as in Example 1, on each of the supports prepared in the foregoing manner was formed a multilayer coating consisting of a subbing layer 1, a subbing layer 2, a heat insulation layer, and a receptor layer, which were stacked on top of each other in the order described.

Preparation of Samples 201 to 206

Samples 201 to 203 were prepared by giving simultaneous multilayer coating to the supports 7 to 9, respectively, so that a triple-layer structure having a subbing layer I, a subbing layer 2, and a receptor layer, described in the increasing order of distance from the support, was formed on each support and the coating amount of the subbing layers 1 and 2 each was adjusted to 11 ml/m$^2$ and that of the receptor layer was adjusted to 18 ml/m$^2$. Samples 204 to 206 were prepared by simultaneous multilayer coating in the same manners as Samples 201 to 203, respectively, except that the heat insulation layer was provided between the subbing layer 2 and the receptor layer and that the coating amount thereof was adjusted to 45 ml/m$^2$.

(Image Formation)

Image outputs were obtained in the same manner as in Example 1, except that Image-receiving sheets samples 201 to 206 were used.

(Evaluation of Dmax)

Evaluation was carried out in the same manner as in Example 1.

(Degree of Contamination of Printer)

The operation of producing output of gray gradations from the foregoing printer DPB 1500 was repeated 10,000 times, and then an output of a black solid image was produced and image defects in the output were counted. By processing a great number of sheets, the pinch rollers and the platen roller mounted in the printer were contaminated and thus image defects were increased. The number of image defects per one sheet of L-size print was counted.

The results obtained are shown in Table 4.

TABLE 4

Supports used in samples and results of evaluation

| Sample No. | Support No. | Adhesive | Hollow-polymer-particle-containing heat insulation layer | Dmax | Degree of contamination of printer (Number of image defects) | Remarks |
|---|---|---|---|---|---|---|
| 201 | Support 7 | Absent | Absent | 1.75 | 10 | Comparative example |
| 202 | Support 8 | Present | Absent | 1.65 | 14 | Comparative example |
| 203 | Support 9 | Present | Absent | 1.62 | 14 | Comparative example |
| 204 | Support 7 | Absent | Present | 2.10 | 11 | This invention |
| 205 | Support 8 | Present | Present | 2.05 | 25 | Comparative example |
| 206 | Support 9 | Present | Present | 2.06 | 26 | Comparative example |

As can be seen from the results shown in Table 4, Sample 204 had both high Dmax and caused less contamination of the printer.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2006-053865 filed in Japan on Feb. 28, 2006 and Patent Application No. 2006-053954 filed in Japan on Feb. 28, 2006, each of which is entirely herein incorporated by reference.

What I claim is:

1. A heat-sensitive transfer image-receiving sheet comprising a support, at least one receptor layer containing a polymer latex, at least one heat insulation layer containing a latex of hollow polymer particles and a gelatin as a binder resin which layer is provided between the support and the receptor layer, and an undercoat layer which layer is provided between the support and the insulation layer and in contact with the insulation layer, wherein the polymer latex contained in the receptor layer is a vinyl chloride/acrylate copolymer latex, wherein an average particle size of the hollow polymer particles is 0.1 to 2 μm, and the hollow polymer particles are non-foaming type hollow polymer latex particles formed of a styrene/acryl resin, wherein each of the undercoat layer and the layers above the undercoat layer contains a latex, and wherein the support comprises a base paper and a resin layer other than a polypropylene layer that is provided at least on the side of the base paper to which the receptor layer is provided.

2. The heat-sensitive transfer image-receiving sheet as claimed in claim 1, wherein the resin layer is a biaxially-stretched microvoid film.

3. The heat-sensitive transfer image-receiving sheet as claimed in claim 1, wherein the heat insulation layer containing hollow polymer particles is free of any resins having poor resistance to an organic solvent except for the hollow polymer particles.

4. The heat-sensitive transfer image-receiving sheet as claimed in claim 1, wherein the gelatin is the only binder resin in the insulation layer.

5. The heat-sensitive transfer image-receiving sheet as claimed in claim 1, wherein the undercoat layer comprises a styrene-butadiene latex.

6. The heat-sensitive transfer image-receiving sheet as claimed in claim 1, comprising at least two undercoat layers provided between the support and the insulation layer.

7. The heat-sensitive transfer image-receiving sheet as claimed in claim 1, wherein the base paper is a base paper which is formed by laminating polyethylene on both sides thereof.

8. The heat-sensitive transfer image-receiving sheet as claimed in claim 1, wherein the base paper is a base paper which is formed by laminating polyethylene on both sides thereof, and the polyethylene laminated on the back side of the base paper is a blend of a high-density polyethylene and a low-density polyethylene in a blend ratio, by mass, of 2/8 to 8/2.

9. The heat-sensitive transfer image-receiving sheet as claimed in claim 1, wherein the base paper is a base paper coated with polyvinyl alcohol on both sides thereof, and the base paper is formed by laminating polyethylene on both sides thereof.

10. The heat-sensitive transfer image-receiving sheet as claimed in claim 1, wherein the receptor layer contains a gelatin.

11. The heat-sensitive transfer image-receiving sheet as claimed in claim 1, wherein the receptor layer contains microcrystalline wax as a releasing agent.

12. The heat-sensitive transfer image-receiving sheet as claimed in claim 1, wherein the receptor layer and/or the insulation layer contains an agent for imparting fastness to images or an ultraviolet absorbent.

13. A heat-sensitive transfer image-receiving sheet comprising a support, at least one receptor layer containing a polymer latex, and at least one heat insulation layer containing a latex of hollow polymer particles and a gelatin as a binder resin which layer is provided between the support and the receptor layer, and an undercoat layer which layer is provided between the support and the insulation layer and in contact with the insulation layer, wherein the polymer latex contained in the receptor layer is a vinyl chloride/acrylate copolymer latex, wherein an average particle size of the hollow polymer particles is 0.1 to 2 μm, and the hollow polymer particles are non-foaming type hollow polymer latex particles formed of a styrene/acryl resin, wherein each of the undercoat layer and the layers above the undercoat layer contains a latex, and wherein the support comprises a base paper and a resin layer which is provided without using an adhesive at least on the side of the base paper to which the receptor layer is provided.

14. The heat-sensitive transfer image-receiving sheet as claimed in claim 13, wherein the resin layer provided on the support is a polyethylene layer.

15. The heat-sensitive transfer image-receiving sheet as claimed in claim 13, wherein the heat insulation layer containing hollow polymer particles is free of any resins having poor resistance to an organic solvent except for the hollow polymer particles.

16. The heat-sensitive transfer image-receiving sheet as claimed in claim 13, wherein the gelatin is the only binder resin in the insulation layer.

17. The heat-sensitive transfer image-receiving sheet as claimed in claim 13, wherein the undercoat layer comprises a styrene-butadiene latex.

18. The heat-sensitive transfer image-receiving sheet as claimed in claim 13, comprising at least two undercoat layers provided between the support and the insulation layer.

19. The heat-sensitive transfer image-receiving sheet as claimed in claim 13, wherein the base paper is a base paper which is formed by laminating polyethylene on both sides thereof.

20. The heat-sensitive transfer image-receiving sheet as claimed in claim 13, wherein the base paper is a base paper which is formed by laminating polyethylene on both sides thereof, and the polyethylene laminated on the back side of the base paper is a blend of a high-density polyethylene and a low-density polyethylene in a blend ratio, by mass, of 2/8 to 8/2.

21. The heat-sensitive transfer image-receiving sheet as claimed in claim 13, wherein the base paper is a base paper coated with polyvinyl alcohol on both sides thereof, and the base paper is formed by laminating polyethylene on both sides thereof.

22. The heat-sensitive transfer image-receiving sheet as claimed in claim 13, wherein the receptor layer contains a gelatin.

23. The heat-sensitive transfer image-receiving sheet as claimed in claim 13, wherein the receptor layer contains microcrystalline wax as a releasing agent.

24. The heat-sensitive transfer image-receiving sheet as claimed in claim 13, wherein the receptor layer and/or the insulation layer contains an agent for imparting fastness to images or an ultraviolet absorbent.

* * * * *